US008424299B2

(12) United States Patent
Kakizawa et al.

(10) Patent No.: US 8,424,299 B2
(45) Date of Patent: Apr. 23, 2013

(54) HYDRAULIC DRIVE DEVICE FOR LARGE HYDRAULIC EXCAVATOR

(75) Inventors: Kenji Kakizawa, Tsuchiura (JP); Yoshinori Furuno, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 1081 days.

(21) Appl. No.: 12/376,857

(22) PCT Filed: Aug. 9, 2007

(86) PCT No.: PCT/JP2007/065601

§ 371 (c)(1), (2), (4) Date: Feb. 9, 2009

(87) PCT Pub. No.: WO2008/018538

PCT Pub. Date: Feb. 14, 2008

(65) Prior Publication Data

US 2010/0162696 A1 Jul. 1, 2010

(30) Foreign Application Priority Data

Aug. 10, 2006 (JP) ..... 2006-218870

(51) Int. Cl.
*F16D 31/02* (2006.01)

(52) U.S. Cl.
USPC ..... 60/368; 60/420

(58) Field of Classification Search ..... 60/420, 60/445, 368
See application file for complete search history.

(56) References Cited

U.S. PATENT DOCUMENTS 5,692,376 A * 12/1997 Miki et al. ..... 60/445
6,167,337 A * 12/2000 Haack et al. ..... 701/50

FOREIGN PATENT DOCUMENTS

JP 2000-336700 A 12/2000
JP 2004-100154 4/2004

OTHER PUBLICATIONS

International Search Report dated Nov. 13, 2007 with English translation (two (2) pages).

* cited by examiner

*Primary Examiner* — Daniel Lopez
(74) *Attorney, Agent, or Firm* — Crowell & Moring LLP

(57) ABSTRACT

A large hydraulic excavator permits an easy change from a machine mode corresponding to a backhoe excavator to a machine mode corresponding to a loader excavator, and vice versa. A hydraulic circuit is provided with hydraulic pumps and directional control valves, solenoid valves for controlling the hydraulic pumps and the directional control valves, and a controller for controlling the solenoid valves in accordance with operation of control lever devices and control pedal devices. The controller performs its control in a backhoe mode or loader mode selectively instructed by a mode instruction unit. Control of the solenoid valves in the backhoe mode makes the hydraulic circuit function as a backhoe hydraulic drive circuit, while control in the loader mode makes the hydraulic circuit function as a loader hydraulic drive circuit.

3 Claims, 17 Drawing Sheets

FIG. 9—1
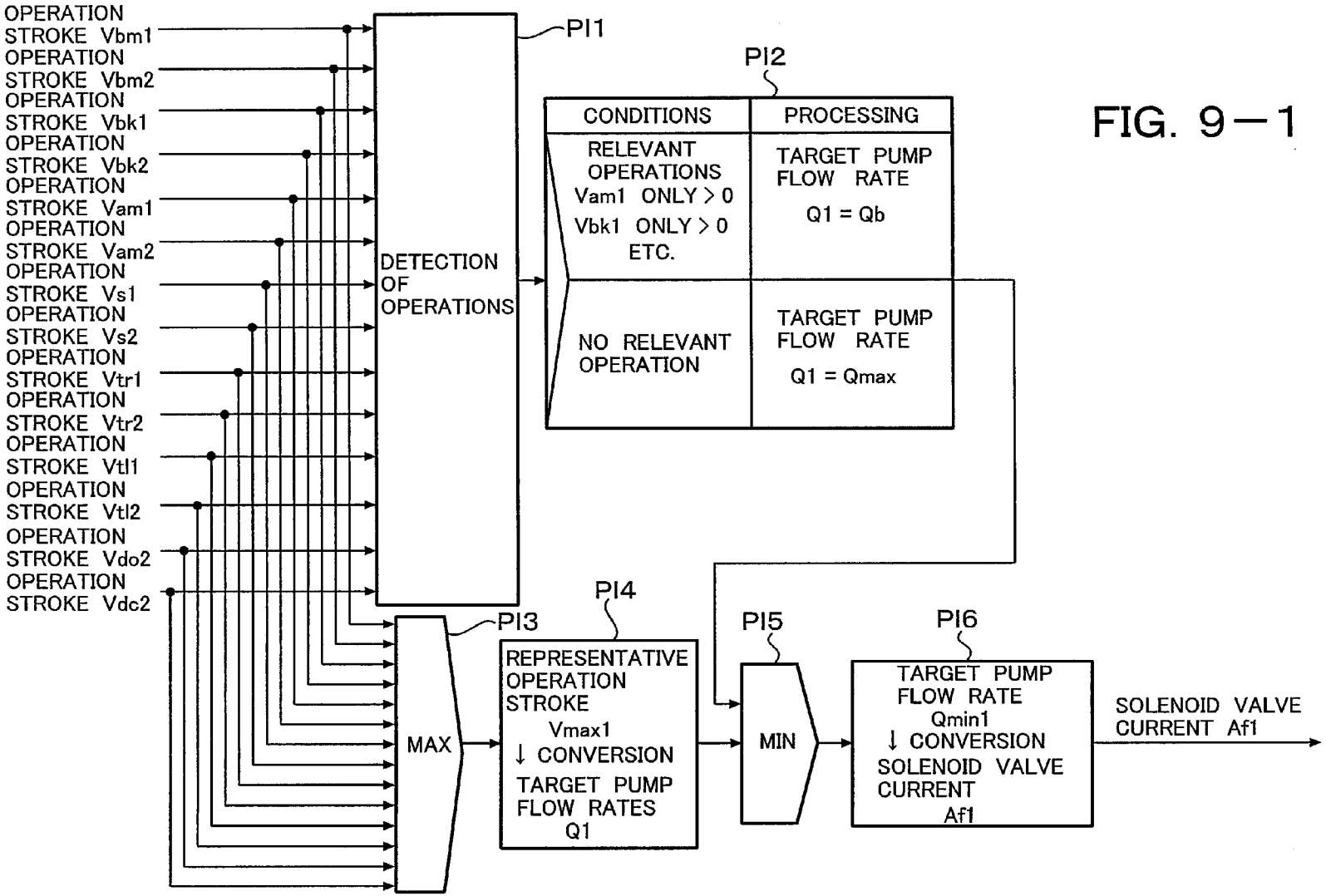

FIG. 9—2
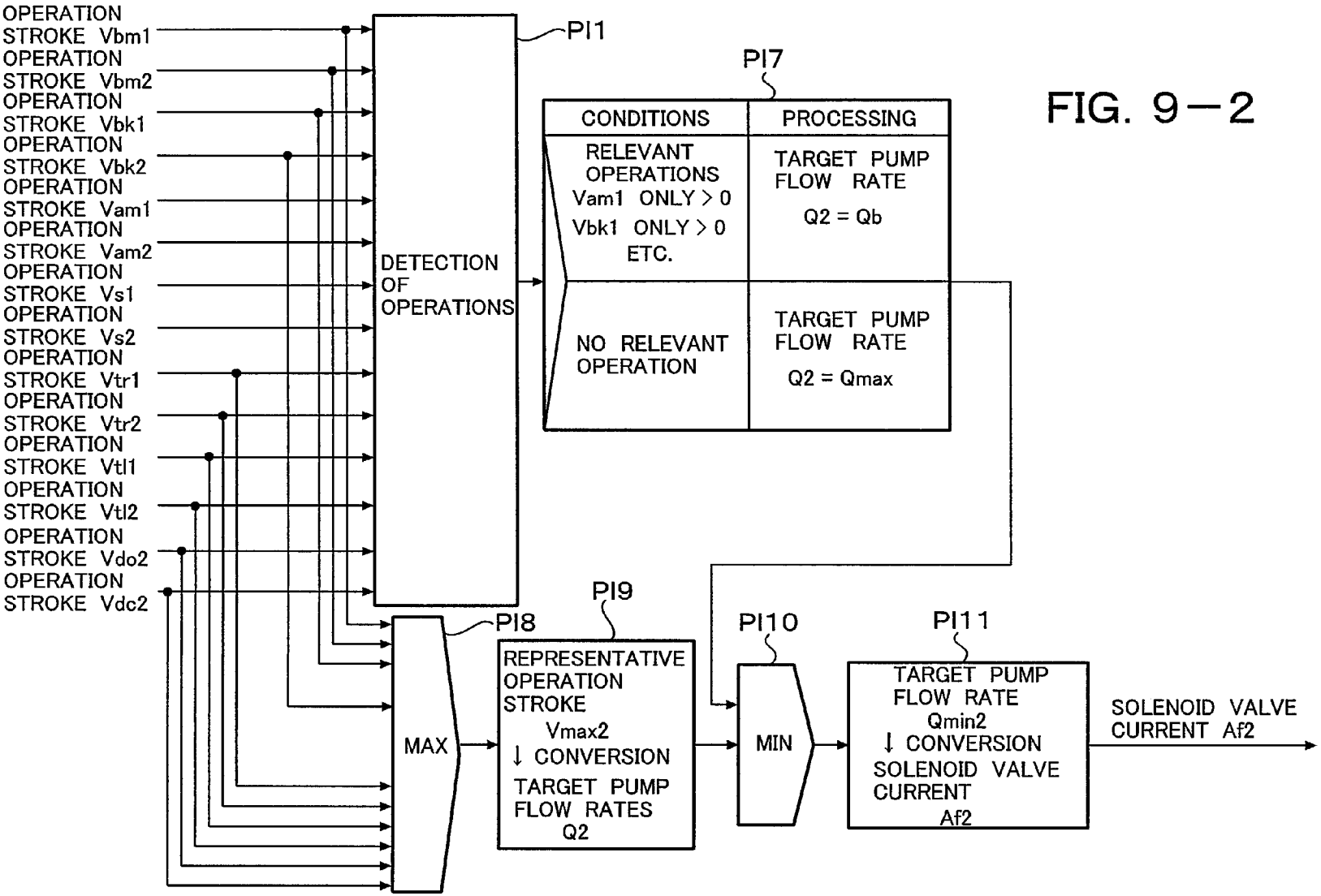

FIG. 9—3
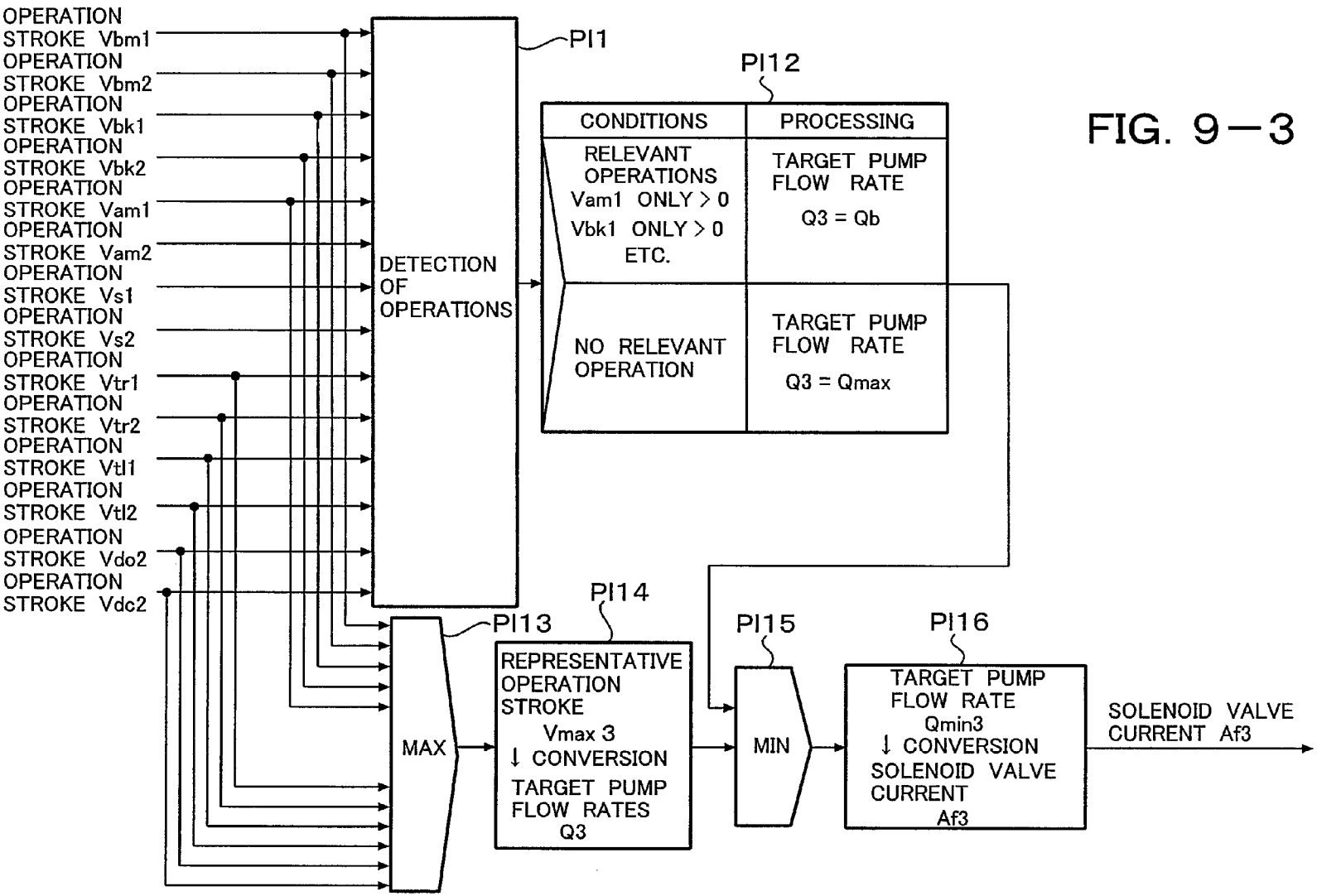

FIG. 10—1
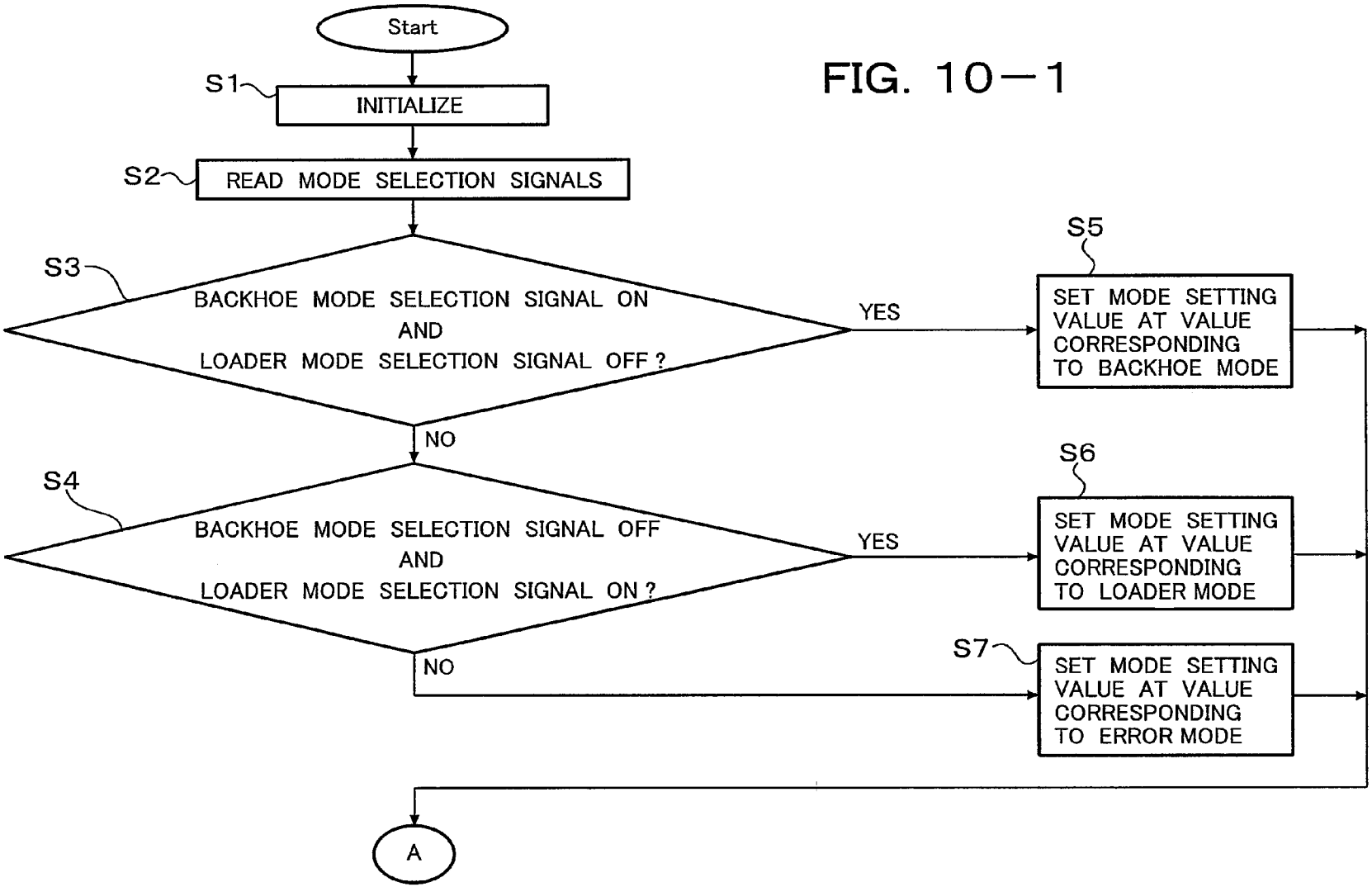

FIG. 10—2
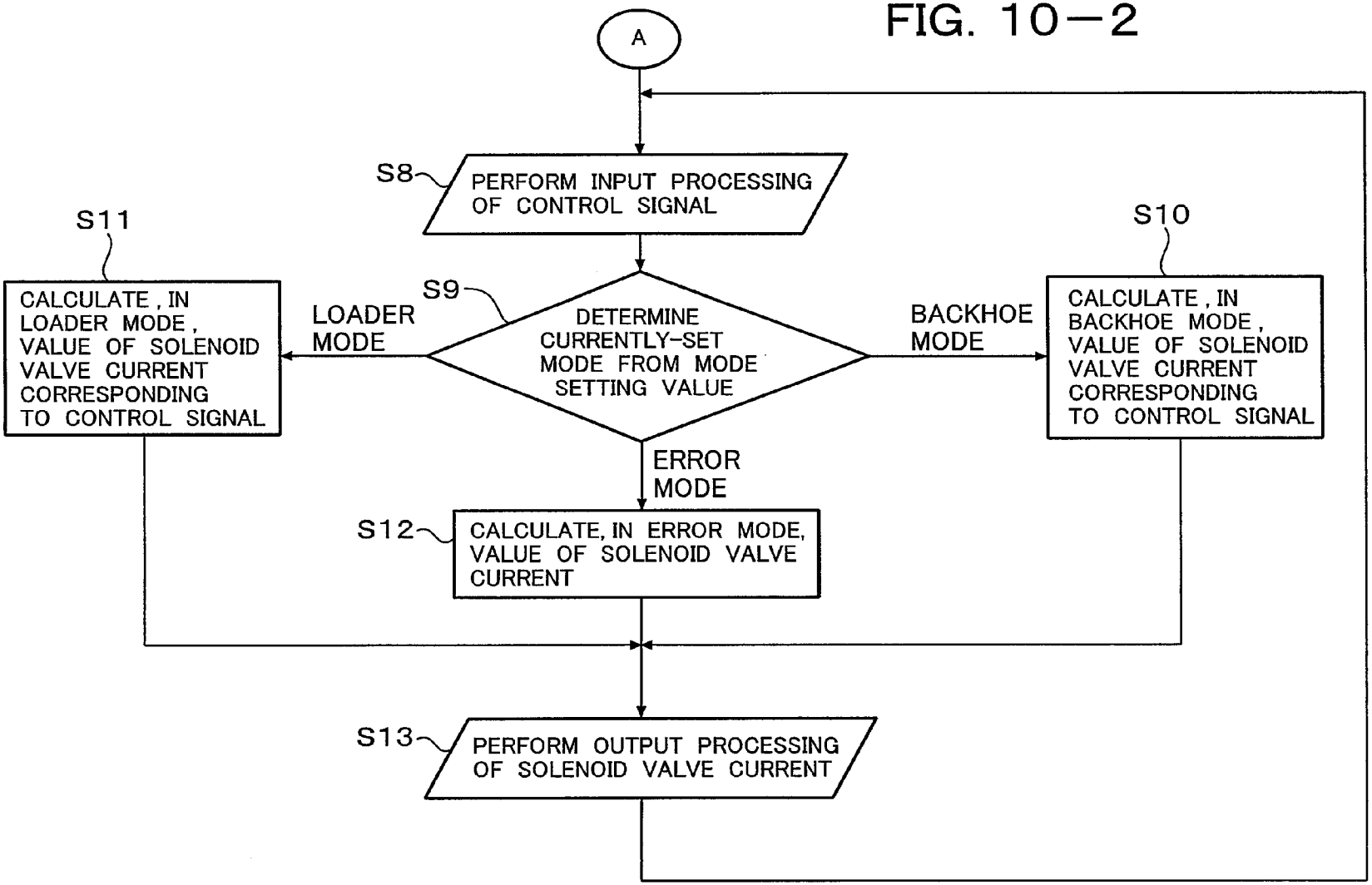

HYDRAULIC DRIVE DEVICE FOR LARGE HYDRAULIC EXCAVATOR

TECHNICAL FIELD

This relates to a hydraulic drive system for a large hydraulic excavator which can be transported in a divided condition and can then be assembled at a location close to a work site.

BACKGROUND ART

A large backhoe excavator (which may hereinafter be called simply "a backhoe") is provided with a travel base capable of traveling by drive of left and right crawler tracks, a revolving upperstructure mounted for revolution on the travel base and having an operator's cab, and a front working assembly having a boom connected to a front part of the revolving upperstructure, an arm pivotally connected to the boom and a bucket pivotally connected to the arm.

The backhoe excavator is also provided with plural hydraulic actuators for driving the travel base, revolving upperstructure and front working assembly, specifically a right travel motor and a left travel motor as drive sources for the travel base, a swing motor as a drive source for the revolving upperstructure, a boom cylinder as a drive source for the boom, an arm cylinder as a drive source for the arm, and a bucket cylinder as a drive source for the bucket.

Arranged in the operator's cab of the backhoe excavator are plural control devices, specifically a right travel control pedal device for instructing operation (operation direction and operation speed) of the right travel motor, a left travel control pedal device for instructing operation of the left travel motor, a swing control lever device for instructing operation of the swing motor, a boom control lever device for instructing operation of the boom cylinder, an arm control lever device for instructing operation of the arm cylinder, and a bucket control lever device for instructing operation of the bucket.

The backhoe excavator is further provided with a hydraulic drive system for operating plural hydraulic actuators, namely, the right travel motor, left travel motor, swing motor, boom cylinder, arm cylinder and bucket cylinder in accordance with operation of the right travel control pedal device, left travel control pedal device, swing control lever device, boom control lever device, arm control lever device and bucket control lever device. This hydraulic drive system is provided with a hydraulic drive circuit including plural variable-displacement hydraulic pumps capable of serving as hydraulic sources for the hydraulic actuators and directional control valves interposed between said plural variable-displacement hydraulic pumps and said plural hydraulic actuators to control flows of pressure oil between the individual variable-displacement hydraulic pumps and the individual hydraulic actuators. In other words, the hydraulic drive system is configured to control the operation directions and operation speeds of the plural hydraulic actuators by controlling regulators for the plural variable-displacement hydraulic pumps and the plural directional control valves in accordance with the operation of the right travel control pedal device, left travel control pedal device, swing control lever device, boom control lever device, arm control lever device and bucket control lever device.

A large loader excavator (which may hereinafter be called simply "a loader excavator") is provided, similar to the backhoe excavator, with a travel base, a revolving upperstructure and a front working assembly, aright travel motor, a left travel motor, a swing motor, a boom cylinder, an arm cylinder and a bucket cylinder as drive sources for them, and a hydraulic drive system for controlling operation of these hydraulic actuators.

As the front working assembly of the backhoe excavator and that of the loader excavator are different in digging operation, the arm cylinder and bucket cylinder are arranged on an outer side of the front working assembly in the backhoe excavator while the arm cylinder and bucket cylinder are arranged on an inner side of the front working assembly in the loader excavator. As a consequence, the pivoting directions of the arm and bucket when the arm cylinder and bucket cylinder extend or retract in the backhoe excavator and those of the arm and bucket when the arm cylinder and bucket cylinder extend or retract in the loader excavator are opposite. In addition, the front working assemblies are also different in the manner of control of flow rates suited for the control of operation speeds.

Further, the bucket of the loader excavator is constructed openably and closably. This bucket is provided with an open/close cylinder as a drive source for the opening/closing of the bucket. Arranged in an operator's cab of the loader excavator are an open control pedal device for instructing a bucket-opening operation and a close control pedal device for instructing a bucket-closing operation. The hydraulic drive system of the loader excavator is constructed such that like the hydraulic drive system of the backhoe excavator, the right travel motor, left travel motor, swing motor, boom cylinder, arm cylinder and bucket cylinder can be operated in accordance with the operation of the right travel control pedal device, left travel control pedal device, swing control lever device, boom control lever device, arm control lever device and bucket control lever device and in addition, such that the open/close cylinder can be operated in accordance with the operation of the open control pedal device or close control pedal device.

As a further large hydraulic excavator constructed like the large backhoe excavator and large loader excavator mentioned above, there is one disclosed in JP-A-2004-100134.

It is to be noted that the kind of large hydraulic excavators to be manufactured is determined to that of those shipped more between backhoe excavators and loader excavators and such large hydraulic excavators may be kept in stock. Subsequently, each large hydraulic excavator is transported in a divided condition to a work site where digging work or the like is to be performed, and is then assembled into the type ordered by the customer. The type of hydraulic excavator ordered by each customer may be different from that of a hydraulic excavator manufactured or kept in stock. As a consequence, it becomes necessary to change the type of the hydraulic excavator from a backhoe excavator to a loader excavator or from a loader excavator to a backhoe excavator in the assembly stage of the hydraulic excavator. When changing the type of a hydraulic excavator as mentioned above, the progress of work at the work site will be substantially delayed from the work schedule if the change is dealt with by doing the fabrication and transportation again from the beginning with respect to all the components of the hydraulic excavator. Accordingly, the change of the hydraulic excavator is conducted by using as many components as possible from the hydraulic excavator before the change, and the thus-changed hydraulic excavator is then delivered.

When changing a hydraulic excavator, which is to be used at a work site, from a backhoe excavator to a loader excavator, for example, the travel base and swing upperstructure and the components of the hydraulic drive system, said components being associated with these travel base and swing upperstructure, that is, the right travel control pedal device, left travel control pedal device, swing control lever device, boom control lever device, arm control lever device and bucket control lever device, all of which exist as components of the backhoe excavator, can be used as they are, and an open control pedal device and a close control pedal device are newly arranged. The front working assembly is replaced by a front working assembly for a loader excavator, and following this replacement, the boom cylinder, arm cylinder and bucket cylinders are also replaced by those corresponding to the loader excavator. An open/close cylinder which is not arranged in the front working assembly for the backhoe excavator is attached to the bucket. Further, the components of the hydraulic drive system, said components being associated with the front working assembly, are modified such that the replaced boom cylinder, arm cylinder and bucket cylinder can be operated in accordance with operation of the existing right travel control pedal device, existing left travel control pedal device, existing swing control lever device, existing boom control lever device, existing arm control lever device and existing bucket control lever device and also, such that the newly-arranged open/close cylinder can be operated in accordance with operation of the newly-arranged open control pedal and newly-arranged close control pedal.

DISCLOSURE OF THE INVENTION

Means to be Solved by the Invention

Upon changing the kind of large hydraulic excavator, which is to be used at a work site, from a backhoe excavator to a loader excavator or from a loader excavator to a backhoe excavator at the time of its assembly, a need arises to change the components of the hydraulic drive system, said components being associated with the front working assembly, as mentioned above.

Whichever of the above-described changes is to be performed, it is necessary to change the components of the hydraulic drive system, said components being associated with the front working assembly, such that the replaced hydraulic cylinders can be operated in accordance with operation of the existing control lever devices. Especially when changing from the backhoe excavator to the loader excavator, a need arises to change the components of the hydraulic drive system, said components being associated with the front working assembly, such that the open/close cylinder can be operated in accordance with operation of the open control pedal device or close control pedal device. The work to perform such changes to the components of the hydraulic drive system, said components being associated with the front working assembly, have been cumbersome.

An object of the present invention is to provide a hydraulic drive system for a large hydraulic excavator, said hydraulic drive system permitting an easy change from one corresponding to a backhoe excavator to one corresponding to a loader excavator or vice versa.

Means for Solving the Problems

[1] This invention is characterized by a hydraulic circuit comprising at least two variable-displacement hydraulic pumps and at least seven directional control valves, said hydraulic circuit being for arrangement on a revolving upperstructure of the large hydraulic excavator such that a first hydraulic drive circuit for a backhoe excavator, which comprises the at least two variable-displacement hydraulic pumps and at least six of the directional control valves to form a flow of pressure oil required for driving a right travel motor, a left travel motor, a swing motor, a boom cylinder, an arm cylinder and a bucket cylinder provided on the large backhoe excavator, and a second hydraulic drive circuit for a loader excavator, which comprises the at least two variable-displacement hydraulic pumps and the at least seven directional control valves to form a flow of pressure oil required for driving a right travel motor, a left travel motor, a swing motor, a boom cylinder, an arm cylinder, a bucket cylinder and an open/close cylinder provided on the large loader excavator, can be selectively controlled, a pump flow-rate control means for controlling flow rates of the at least two variable-displacement hydraulic pumps, respectively, a directional control means for controlling valve positions of the at least seven directional control valves, respectively, a regulation means for performing control of the pump flow-rate control means and the directional control means in one mode selected from predetermined at least two modes, and a mode instruction means for instructing the one mode to be selected by the regulation means from the at least two modes, wherein the at least two modes comprises a backhoe mode, in which the pump flow-rate control means and the directional control means are controlled to make the hydraulic circuit function as the first hydraulic drive circuit for the backhoe excavator, and a loader mode, in which the pump flow-rate control means and the directional control means are controlled to make the hydraulic circuit function as the second hydraulic drive circuit for the loader excavator.

According to the present invention constructed as described above, owing to the arrangement of the hydraulic circuit that can selectively construct the first hydraulic drive circuit for the backhoe excavator or the second hydraulic drive circuit for the loader excavator, it is unnecessary to change the numbers and arrangements of the variable-displacement hydraulic pumps and directional control valves upon changing the hydraulic drive circuit of the large hydraulic excavator from the first hydraulic drive circuit for the backhoe excavator to the second hydraulic drive circuit for the loader excavator or from the second hydraulic drive circuit for the loader excavator to the first hydraulic drive circuit for the backhoe excavator. Further, by instructing the selection of the backhoe mode to the regulation means from the mode instruction means, it become possible to control the flow-rate control means and directional control means such that the hydraulic circuit can function as the hydraulic drive circuit for the backhoe excavator. Furthermore, by instructing the selection of the loader mode to the regulation means from the mode instruction means, it becomes possible to control the flow-rate control means and directional control means such that the hydraulic circuit can function as the hydraulic drive circuit for the loader excavator. Owing to these, it is possible to achieve the above-mentioned object, that is, the provision of a hydraulic drive system for a large hydraulic excavator, said hydraulic drive system permitting an easy change from one corresponding to a backhoe excavator to one corresponding to a loader excavator or vice versa.

[2] The present invention may be characterized as described in [1] above wherein: regulators that make pump flow rates in the variable-displacement hydraulic pumps variable comprise hydraulic pilot-operated regulators, the pump flow-rate control means comprises plural flow-rate control solenoid valves arranged such that pilot pressures can be applied to the regulators for the respective variable-displacement hydraulic pumps, the directional control valves comprise hydraulic pilot-operated directional control valves, the directional control means comprises plural directional control solenoid valves arranged such that pilot pressures can be applied to the respective directional control valves, the regulation means has a computer that realizes control of the pump flow-rate control means and directional control valve control means in each of the at least two modes by electronic control of the plural flow-rate control solenoid valves and plural directional-control solenoid valves, and the mode instruction means has an electric circuit for generating an electric signal that instructs the kind of the mode, which is to be selected from the at least two modes, to the computer.

[3] The present invention may be constructed in accordance with the following (1) to (14) based on the invention as described in [1] above.

(1) The at least two variable-displacement hydraulic pumps comprise first to eighth variable-displacement hydraulic pumps, and these first to eighth variable-displacement hydraulic pumps are grouped into a first pump unit composed of the first variable-displacement hydraulic pump and the second variable-displacement hydraulic pump, a second pump unit composed of the third variable-displacement hydraulic pump and the fourth variable-displacement hydraulic pump, a third pump unit composed of the fifth variable-displacement hydraulic pump and the sixth variable-displacement hydraulic pump, and a fourth pump unit composed of the seventh variable-displacement hydraulic pump and the eighth variable-displacement hydraulic pump, (2) The at least seven directional control valves comprise first to fifteenth directional control valves, and these first to fifteenth directional control valves are grouped into a first valve group composed of the first to fourth directional control valves, a second valve group composed of the fifth to eighth directional control valves, a third valve group composed of the ninth to eleventh directional control valves, and a fourth valve group composed of the twelfth to fifteenth directional control valves, (3) To these first to fourth valve groups, the first to fourth pump units are connected, respectively, via lines each of which combines together the two variable-displacement hydraulic pumps that make up the corresponding pump unit, (4) The first, fifth and fourteenth directional control valves are arranged such that selective switching of flow rate and flow direction of pressure oil corresponding to each of an extension and a retraction of the boom cylinder provided on the backhoe excavator and selective switching of flow rate and flow direction of pressure oil corresponding to each of an extension and a retraction of the boom cylinder provided on the loader excavator can be performed, (5) The second, sixth and thirteenth directional control valves are arranged such that selective switching of flow rate and flow direction of pressure oil corresponding to each of an extension and a retraction of the bucket cylinder provided on the backhoe excavator and selective switching of flow rate and flow direction of pressure oil corresponding to each of an extension and a retraction of the bucket cylinder provided on the loader excavator can be performed, (6) The third and seventh directional control valves are arranged such that selective switching of flow rate and flow direction of pressure oil corresponding to each of an extension and a retraction of the arm cylinder provided on the backhoe excavator and selective switching of flow rate and flow direction of pressure oil corresponding to each of an extension and a retraction of the arm cylinder provided on the loader excavator can be performed, (7) The fourth directional control valve is arranged such that selective switching of flow rate and flow direction of pressure oil corresponding to each of rotations in opposite two directions of the left travel motor provided on the backhoe excavator and selective switching of flow rate and flow direction of pressure oil corresponding to each of rotations in opposite two directions of the left travel motor provided on the loader excavator can be performed, (8) The eighth directional control valve is arranged such that selective switching of flow rate and flow direction of pressure oil corresponding to each of an extension and a retraction of the open/close cylinder provided on the loader excavator can be performed, (9) The ninth directional control valve is arranged such that selective switching of flow rate and flow direction of pressure oil corresponding to each of an extension of the bucket cylinder provided on the backhoe excavator and an extension of the arm cylinder provided on the backhoe excavator and selective switching of flow rate and flow direction of pressure oil corresponding to each of an extension of the bucket cylinder provided on the loader excavator and an extension of the arm cylinder provided on the loader excavator can be performed,

(10) The tenth directional control valve is arranged such that selective switching of flow rate and flow direction of pressure oil corresponding to each of rotations in opposite two directions of the swing motor provided on the backhoe excavator and selective switching of flow rate and flow direction of pressure oil corresponding to each of rotations in opposite two directions of the swing motor provided on the loader excavator can be performed,

(11) The eleventh directional control valve is arranged such that selection of flow rate and flow direction of pressure oil corresponding to only an extension of the extension and a retraction of the boom cylinder provided on the backhoe excavator and selection of only an extension of the extension and a retraction of the boom cylinder provided on the loader excavator can be performed,

(12) The twelfth directional control valve is arranged such that selective switching of flow rate and flow direction of pressure oil corresponding to each of rotations in opposite two directions of the right travel motor provided on the backhoe excavator and selective switching of flow rate and flow direction of pressure oil corresponding to each of rotations in opposite two directions of the right travel motor provided on the loader excavator can be performed,

(13) The fifteenth directional control valve is arranged such that selective switching of flow rate and flow direction of pressure oil corresponding to each of an extension and a retraction of the arm cylinder provided on the backhoe excavator out of the backhoe excavator and loader excavator can be performed,

(14) The plural flow-rate control solenoid valves comprise first, second and third flow-rate control solenoid valves, the first flow-rate control solenoid valve is arranged such that pilot pressures can be applied to only regulators for the first, third, fifth, sixth, seventh and eighth variable-displacement hydraulic pumps out of regulators for the first to eighth variable-displacement hydraulic pumps, the second flow-rate control solenoid valve is arranged such that a pilot pressure can be applied to only a regulator for the second variable-displacement hydraulic pump out of the regulators for the first to eighth variable-displacement hydraulic pumps, and the third flow-rate control solenoid valve is arranged such that a pilot pressure can be applied to only a regulator for the fourth variable-displacement hydraulic pump out of the regulators for the first to eighth variable-displacement hydraulic pumps.

[4] The present invention may be constructed in accordance with the following (1) to (13) based on the invention as described in [1] above.

(1) The at least two variable-displacement hydraulic pumps comprise first to sixth variable-displacement hydraulic pumps, and these first to sixth variable-displacement hydraulic pumps are grouped into a first pump unit composed of the first variable-displacement hydraulic pump and the second variable-displacement hydraulic pump, a second pump unit composed of the third variable-displacement hydraulic pump and the fourth variable-displacement hydraulic pump, and a third pump unit composed of the fifth variable-displacement hydraulic pump and the sixth variable-displacement hydraulic pump, (2) The at least seven directional control valves comprise first to twelfth directional control valves, and these first to twelfth directional control valves are grouped into a first valve group composed of the first to fourth directional control valves, a second valve group composed of the fifth to eighth directional control valves, and a third valve group composed of the ninth to twelfth directional control valves, (3) To these first to third valve groups, the first, second and third pump units are connected, respectively, via lines each of which combines together the two variable-displacement hydraulic pumps that make up the corresponding pump unit, (4) The first and eleventh directional control valves are arranged such that selective switching of flow rate and flow direction of pressure oil corresponding to each of an extension and a retraction of the bucket cylinder provided on the backhoe excavator and selective switching of flow rate and flow direction of pressure oil corresponding to each of an extension and a retraction of the bucket cylinder provided on the loader excavator can be performed, (5) The second and twelfth directional control valves are arranged such that selective switching of flow rate and flow direction of pressure oil corresponding to each of an extension and a retraction of the boom cylinder provided on the backhoe excavator and selective switching of flow rate and flow direction of pressure oil corresponding to each of an extension and a retraction of the boom cylinder provided on the loader excavator can be performed, (6) The third and fifth directional control valves are arranged such that selective switching of flow rate and flow direction of pressure oil corresponding to each of an extension and a retraction of the arm cylinder provided on the backhoe excavator and selective switching of flow rate and flow direction of pressure oil corresponding to each of an extension and a retract ion of the arm cylinder provided on the loader excavator can be performed, (7) The fourth directional control valve is arranged such that selective switching of flow rate and flow direction of pressure oil corresponding to each of rotations in opposite two direct ions of the left travel motor provided on the backhoe excavator and selective switching of flow rate and flow direction of pressure oil corresponding to each of rotations in opposite two directions of the left travel motor provided on the loader excavator can be performed, (8) The sixth directional control valve is arranged such that selective switching of flow rate and flow direction of pressure oil corresponding to each of an extension and a retraction of the bucket cylinder provided on the backhoe excavator and selective switching of flow rate and flow direction of pressure oil corresponding to each of an extension and a retraction of the open/close cylinder provided on the loader excavator can be performed, (9) The seventh directional control valve is arranged such that selective switching of flow rate and flow direction of pressure oil corresponding to each of an extension and a retraction of the boom cylinder provided on the backhoe excavator and selective switching of flow rate and flow direction of pressure oil corresponding to each of an extension and a retraction of the bucket cylinder provided on the loader excavator can be performed,

(10) The eighth directional control valve is arranged such that selective switching of flow rate and flow direction of pressure oil corresponding to each of rotations in opposite two directions of the right travel motor provided on the backhoe excavator and selective switching of flow rate and flow direction of pressure oil corresponding to each of rotations in opposite two directions of the right travel motor provided on the loader excavator can be performed,

(11) The ninth directional control valve is arranged such that selective switching of flow rate and flow direction of pressure oil corresponding to each of rotations in opposite two directions of the swing motor provided on the backhoe excavator and selective switching of flow rate and flow direction of pressure oil corresponding to each of rotations in opposite two directions of the swing motor provided on the loader excavator can be performed,

(12) The tenth directional control valve is arranged such that selective switching of flow rate and flow direction of pressure oil corresponding to each of an extension and a retraction of the arm cylinder provided on the backhoe excavator and selection of flow rate and flow direction of pressure oil corresponding to only an extension of the extension and a retraction of the arm cylinder provided on the loader excavator can be performed, and

(13) The plural flow-rate control solenoid valves comprise first, second and third flow-rate control solenoid valves, the first flow-rate control solenoid valve is arranged such that a pilot pressure can be applied to only a regulator for the first variable-displacement hydraulic pump out of regulators for the first to sixth variable-displacement hydraulic pumps, the second flow-rate control solenoid valve is arranged such that pilot pressures can be applied to only regulators for the second, third and fourth variable-displacement hydraulic pumps out of the regulators for the first to sixth variable-displacement hydraulic pumps, and the third flow-rate control solenoid valve is arranged such that pilot pressures can be applied to only regulators for the fifth and sixth variable-displacement hydraulic pumps out of the regulators for the first to sixth variable-displacement hydraulic pumps.

[5] The present invention as described in [2] may be characterized in that the electric circuit is provided with a first signal generation circuit for generating a backhoe mode selection signal that instructs selection of the backhoe mode, a first connector capable of switching on/off the first signal generation circuit, a second signal generation circuit for generating a loader mode selection signal that instructs selection of the loader mode, and a second connector capable of switching on/off the second signal generation circuit.

According to the present invention constructed as described above, the mode can be set in the backhoe mode by bringing the second connector into a disconnected state while maintaining the first connector in a connected state, and further, the mode can be set for the loader excavator by bringing the second connector into a connected state while maintaining the first connector in a disconnected state. Therefore, the mode can be changed by the simple work that each connector is pulled out or pushed in, so that the mode can be changed with ease. In addition, the first and second signal generation circuits are electric circuits of simple construction so that any trouble can be readily found and their maintenance is easy.

[6] The present invention as described in [5] above may be characterized in that the computer is configured to perform mode setting by performing reading of the backhoe mode selection signal and loader mode selection signal only once between power on and power off before control of the plural flow-rate control solenoid valve and control of the directional control solenoid valves are first initiated.

According to the present invention constructed as described above, even if a disconnection or short-circuit occurs in the first signal generation circuit or second signal generation circuit during work by the hydraulic excavator, it is possible to avoid such a situation that the mode is changed from the backhoe mode to the loader mode or from the loader mode to the backhoe mode. It is, therefore, possible to avoid a faulty operation of the hydraulic excavator, which would otherwise be caused by a disconnection or short-circuit in the first signal generation circuit or second signal generation circuit.

[7] The present invention as described in [6] above may be characterized in that the at least two kinds of modes comprise an error mode in which control is performed to prevent operation of the plural flow-rate control solenoid valves and plural directional control solenoid valves, the computer is configured to set the mode in the error mode when the results of the reading are results that the backhoe mode selection signal and the loader mode selection signal have been both read or when the results of the reading are results that neither the backhoe mode selection signal nor the loader mode selection signal has been read, and the hydraulic drive system is provided with a display means for displaying the results of the reading.

According to the present invention constructed as described above, it is possible to confirm, by looking at the display of the display means, whether or not the results of the reading of the backhoe mode selection signal or loader mode selection signal by the computer are the results corresponding to the states of the first and second connectors. As a consequence, the present invention can contribute to the detection of a mix-up of the states of the first and second connectors corresponding to each of the backhoe mode and loader mode and also to the detection of a disconnection or short-circuit in the first or second signal generation circuit.

Advantageous Effects of the Invention

According to the present invention, it is possible, as mentioned above, to provide a hydraulic drive system for a large hydraulic excavator, said hydraulic drive system permitting an easy change from one corresponding to a backhoe excavator to one corresponding to a loader excavator or vice versa. Therefore, the labor required for the above-described changing work can be reduced, and further, the time required for the work can be shortened.

BRIEF DESCRIPTION OF THE DRAWINGS

FIGS. 9-1 is a diagram illustrating processing for controlling the $1^{st}$ flow-rate control solenoid valve, said processing being to be performed when the controller depicted in FIG. 5 is a loader mode.

FIGS. 9-2 is a diagram illustrating processing for controlling the $2^{nd}$ flow-rate control solenoid valve, said processing being to be performed when the controller depicted in FIG. 5 is in the loader mode.

FIGS. 9-3 is a diagram illustrating processing for controlling the $3^{rd}$ flow-rate control solenoid valve, said processing being to be performed when the controller depicted in FIG. 5 is in the loader mode.

FIGS. 10-1 is a flowchart illustrating a routine when the controller depicted in FIG. 5 controls the $1^{st}$, $2^{nd}$ and $3^{rd}$ flow-rate control solenoid valves and $1^{st}$-$16^{th}$ directional control solenoid valves.]

FIGS. 10-2 is a continuation of the flowchart illustrated in FIGS. 10-1.

BEST MODES FOR CARRYING OUT THE INVENTION

A description will be made about a large hydraulic excavator to which embodiments of the present invention for the large hydraulic excavator can be applied.

Figure 1:
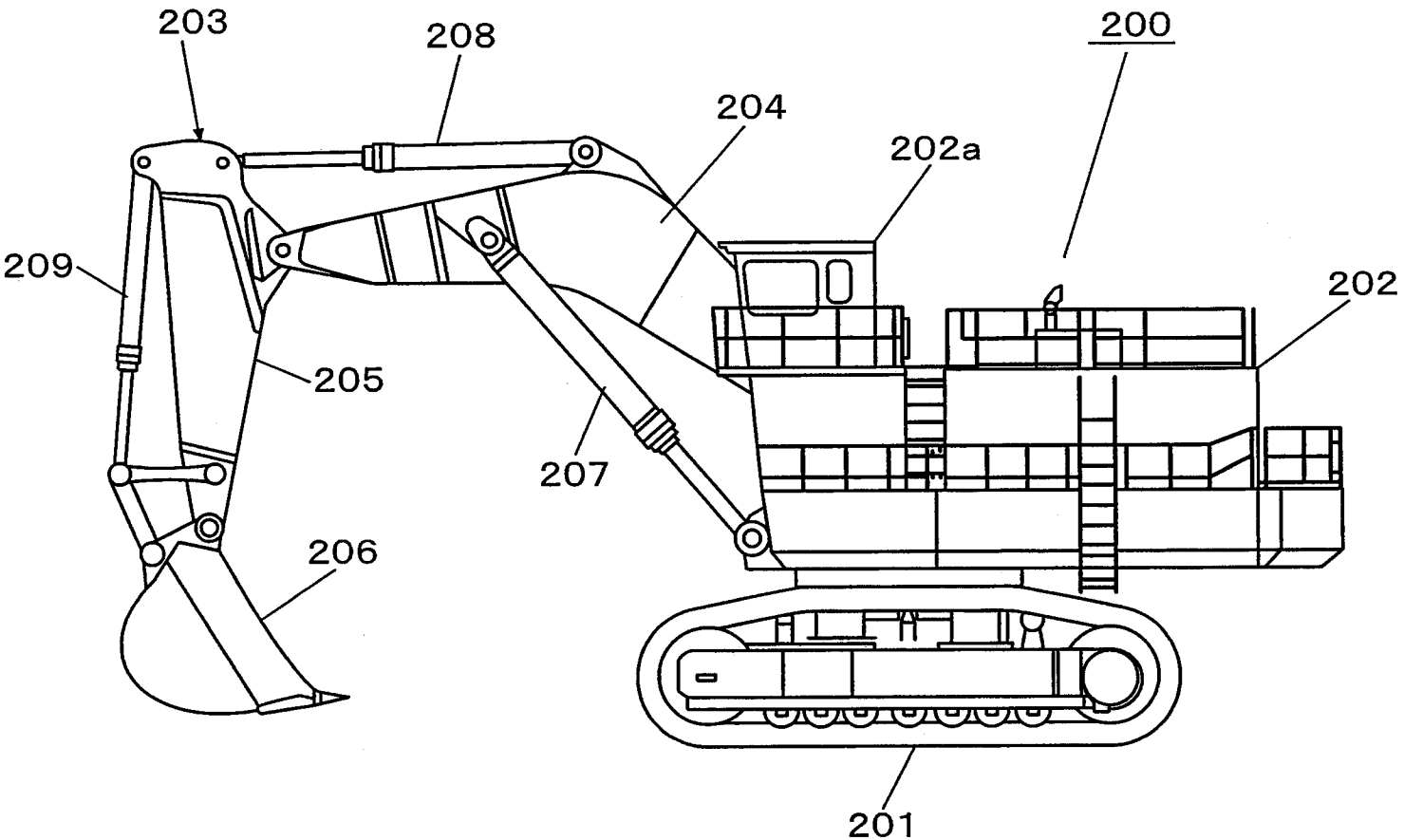
FIG. 1 is a side view of a large backhoe excavator to which embodiments of a hydraulic drive system of the present invention for a large hydraulic excavator can be applied.

FIG. 1 is a side view of a large backhoe excavator to which the embodiments of the present invention can be applied.

The backhoe excavator 200 depicted in FIG. 1 is provided with a travel base 201 capable of traveling by drive of left and right crawler tracks, a revolving upperstructure 202 mounted for revolution as a main unit of the backhoe excavator 200 on the travel base 201 and having an operator's cab 202*a*, and a front working assembly 203 having a boom 204 connected to a front part of the revolving upperstructure 202, an arm 205 pivotally connected to the boom 204 and a bucket 206 pivotally connected to the arm 205.

The backhoe excavator 200 is provided with a right travel motor (not shown) and a left travel motor (not shown) as drive sources for the travel base 201, a swing motor (not shown) as a drive source for the revolving upperstructure 202, a boom cylinder 207 as a drive source for the boom 204, an arm cylinder 208 as a drive source for the arm 205, and a bucket cylinder 209 as a drive source for the bucket 206.

Arranged in the operator's cab 202*a* of the backhoe excavator 200 are plural control devices (not shown), specifically a right travel control pedal device for instructing operation (operation direction and operation speed) of the right travel motor, a left travel control pedal device for instructing operation of the left travel motor, a swing control lever device for instructing operation of the swing motor, a boom control lever device for instructing operation of the boom cylinder 207, an arm control lever device for instructing operation of the arm cylinder 208, and a bucket control lever device for instructing operation of the bucket cylinder 209.

The revolving upperstructure 202 of the backhoe excavator 200 is further provided with a hydraulic drive system (not shown) for controlling operation of the right travel motor, left travel motor, swing motor, boom cylinder 207, arm cylinder 208 and bucket cylinder 209 in accordance with individual instructions (control signals) from the right travel control pedal device, left travel control pedal device, swing control lever device, boom control lever device, arm control lever device and bucket control lever device.

Figure 2:
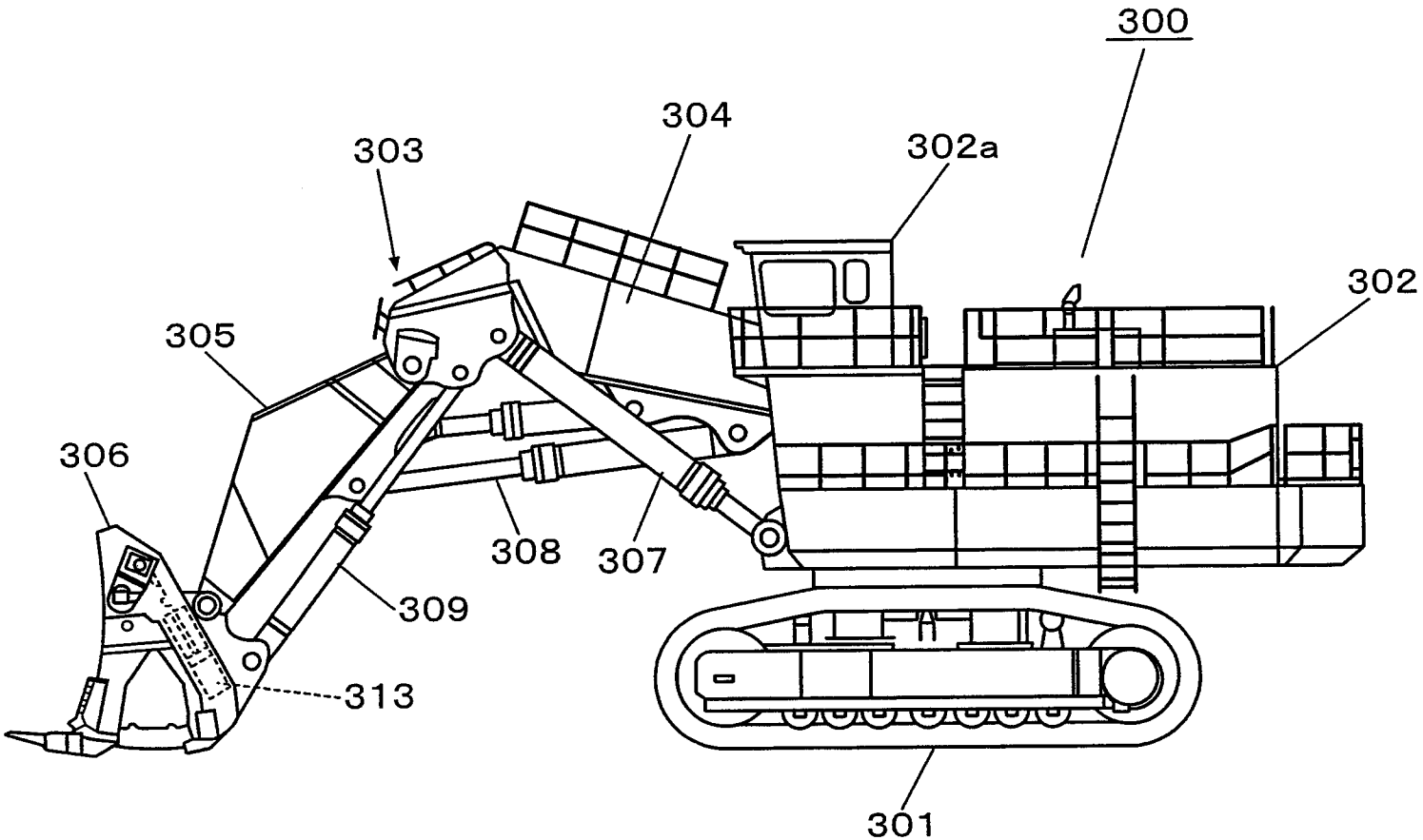
FIG. 2 is a side view of a large loader excavator to which the embodiments of the hydraulic drive system of the present invention for the large hydraulic excavator can be applied.

FIG. 2 is a side view of a large loader excavator to which the embodiment of the present invention is applied.

The large loader excavator 300 depicted in FIG. 2 is provided with a travel base 301, a revolving upperstructure 302 and a front working assembly 303, plural hydraulic actuators for driving them, specifically a right travel motor (not shown), a left travel motor (not shown), a swing motor (not shown), a boom cylinder 307, an arm cylinder 308 and a bucket cylinder 309, and a hydraulic drive system (not shown) for controlling operation of these hydraulic actuators.

In the loader excavator 300, the travel base 301 and revolving upperstructure 302 and the components of the hydraulic drive circuit, said components being for driving the right travel motor, left travel motor and swivel motor, are constructed as in the above-mentioned large backhoe excavator 200 depicted in FIG. 1. The boom 304, arm 305 and bucket 306 in the front working assembly 303 of the loader excavator 300 have different constructions from the above-mentioned corresponding ones depicted in FIG. 1.

As already described in the Background Art, the front working assembly 203 of the backhoe excavator 200 and the front working assembly 303 of the loader excavator 300 are different in digging operation so that the arm cylinder 208 and bucket cylinder 209 are arranged on an outer side of the front working assembly 203 in the backhoe excavator 200 while the arm cylinder 308 and bucket cylinder 309 are arranged on an inner side of the front working assembly 303 in the loader excavator 300. As a consequence, the pivoting directions of the arm 205 and bucket 209 when the arm cylinder 208 and bucket cylinder 209 extend or retract in the backhoe excavator 200 and those of the arm 305 and bucket 306 when the arm cylinder 308 and bucket cylinder 309 extend or retract in the loader excavator 300 are opposite. In addition, the front working assembly 203 and the front working assembly 303 are also different in the manner of control of flow rates suited for the control of operation speeds.

Further, the bucket 306 in the front working assembly 303 of the loader excavator 303 is constructed openably and closably. This bucket 306 is provided with an open/close cylinder 313 as a drive source for opening/closing operation. Arranged in an operator's cab 302*a* of the loader excavator 300 are an open control pedal device (not shown) for instructing operation to open the bucket 306 and a close control pedal device (not shown) for instructing operation to close the bucket 306, and the open control pedal device and close control pedal device are constructed similar to the above-mentioned right travel control pedal device. The hydraulic drive system of the loader excavator 300 is constructed such that like the hydraulic drive system of the backhoe excavator 200, the right travel motor, left travel motor, swing motor, boom cylinder 307, arm cylinder 308 and bucket cylinder 309 can be operated in accordance with the operation of the right travel control pedal device, left travel control pedal device, swing control lever device, boom control lever device, arm control lever device and bucket control lever device and in addition, such that the open/close cylinder 313 can be operated in accordance with the operation of the open control pedal device or close control pedal device.

First Embodiment

A description will be made about a first embodiment of the present invention.

Figure 3:
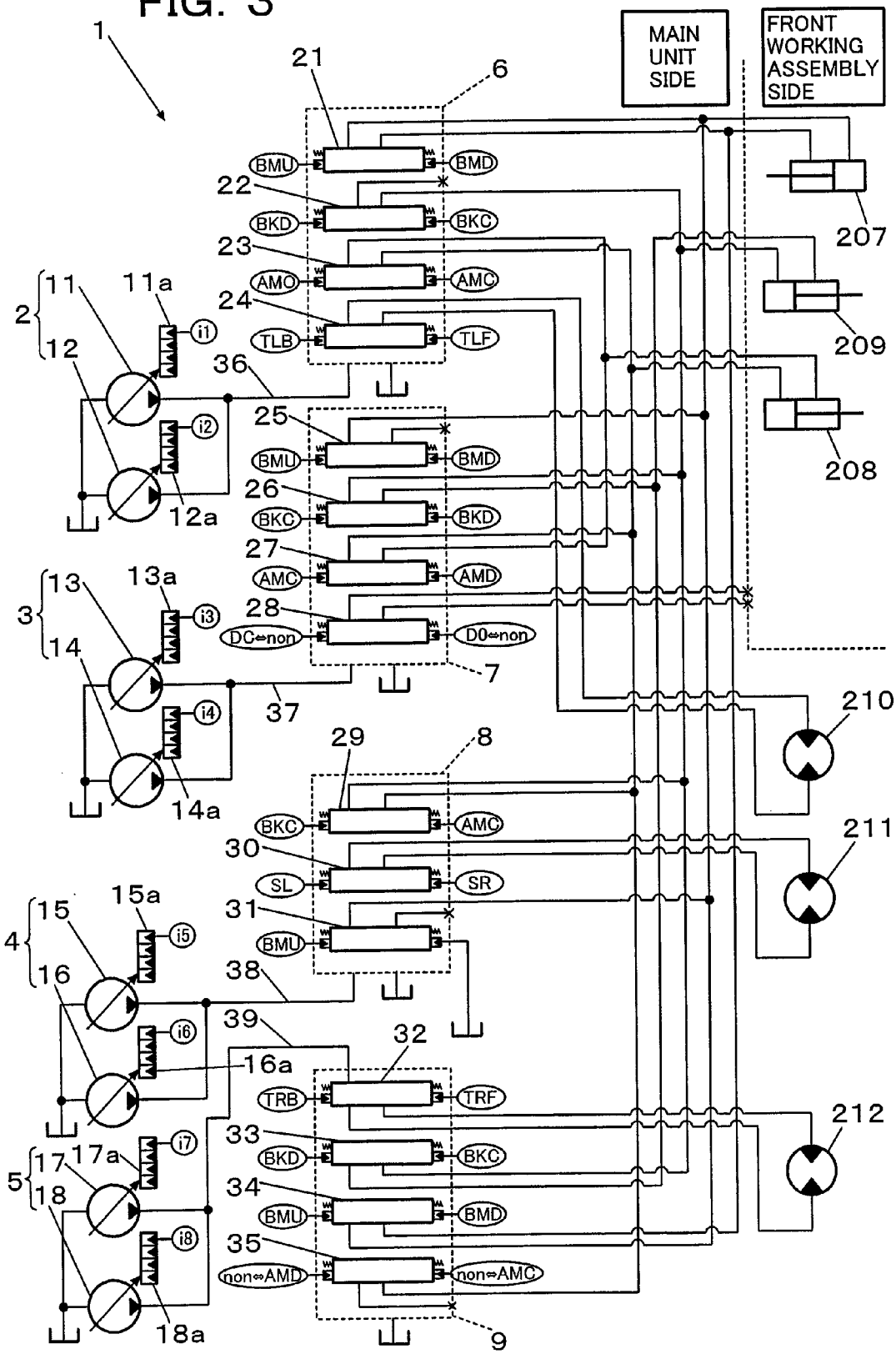
FIG. 3 is a diagram illustrating a state that a hydraulic circuit arranged in a first embodiment of the hydraulic drive system of this invention for the large hydraulic excavator is connected to a left travel motor, a right travel motor, a swing motor, a boom cylinder, an arm cylinder and a bucket cylinder arranged on the backhoe excavator.
Figure 4:
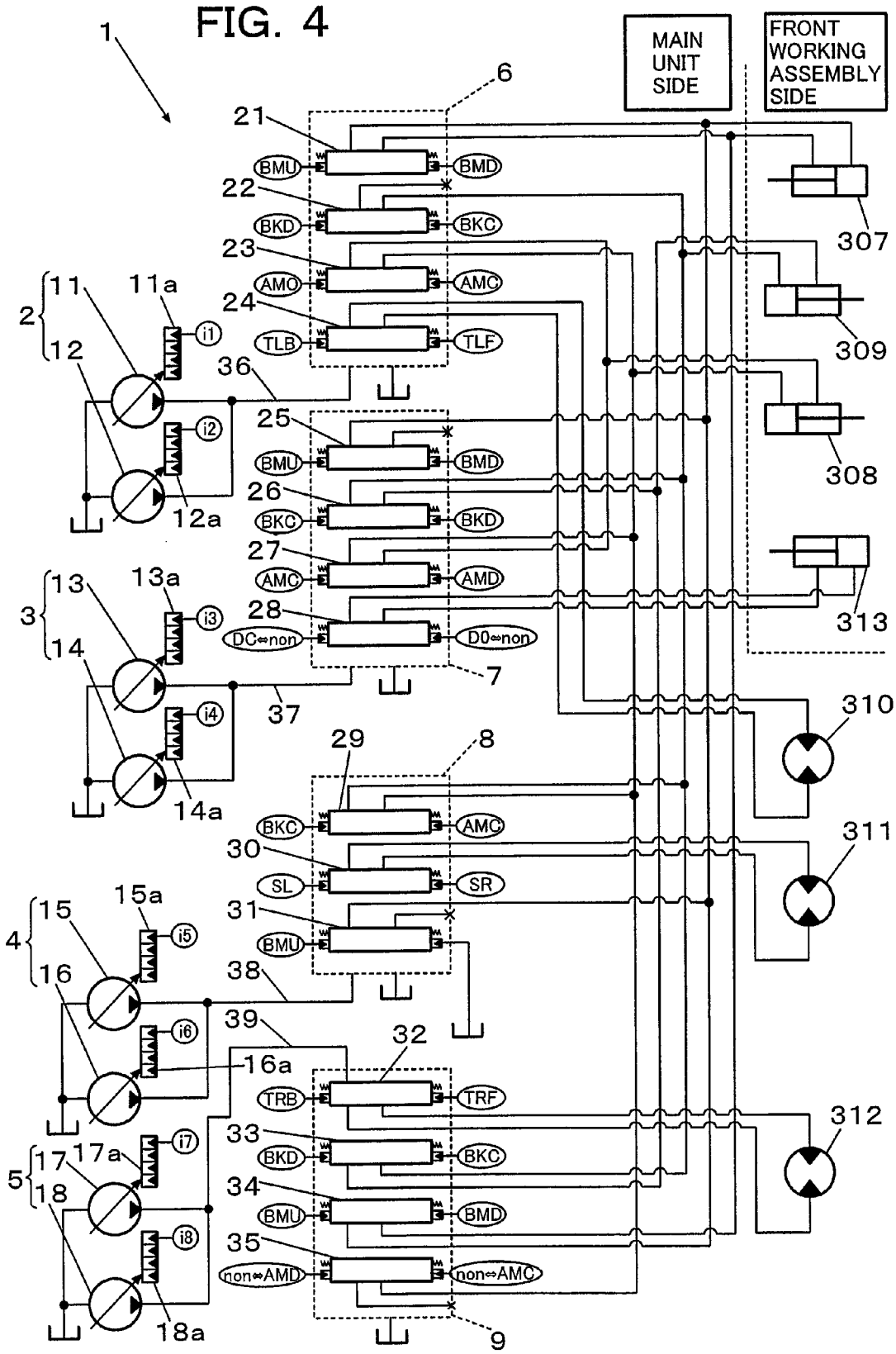
FIG. 4 is a diagram showing a state that the hydraulic circuit depicted in FIG. 3 is connected to a left travel motor, a right travel motor, a swing motor, a boom cylinder, an arm cylinder, a bucket cylinder and an open/close cylinder arranged on the loader excavator.

FIG. 3 is a diagram illustrating a state that a hydraulic circuit arranged in the first embodiment of the hydraulic drive system of this invention for the large hydraulic excavator is connected to the left travel motor, right travel motor, swing motor, boom cylinder, arm cylinder and bucket cylinder arranged on the backhoe excavator. FIG. 4 is a diagram showing a state that the hydraulic circuit depicted in FIG. 3 is connected to the left travel motor, right travel motor, swing motor, boom cylinder, arm cylinder, bucket cylinder and open/close cylinder arranged on the loader excavator.

As illustrated in these FIGS. 3 and 4, the first embodiment is provided with a hydraulic circuit 1 including at least two variable-displacement hydraulic pumps and at least seven directional control valves, for example, $1^{st}$-$8^{th}$ variable-displacement hydraulic pumps 11-18 and $1^{st}$-$15^{th}$ directional control valves 21-35 arranged on the revolving upperstructure of the large hydraulic excavator such that they can selectively construct a hydraulic drive circuit for the backhoe excavator to drive the boom cylinder 207, bucket cylinder 209, arm cylinder 208, left travel motor 210, swing motor 211 and right travel motor 212 arranged on the backhoe excavator 200 or a hydraulic drive circuit for the loader excavator to drive the boom cylinder 307, bucket cylinder 309, arm cylinder 308, open/close cylinder 313, left travel motor 310, swing motor 311 and right travel motor 312 arranged on the loader excavator 300.

In FIGS. 3 and 4, i1-i8 indicate pilot pressures applied to regulators 11*a*-18*a* for the $1^{st}$-$8^{th}$ variable-displacement hydraulic pumps 11-18.

Also in FIGS. 3 and 4, BMU, BMD, BKC, BKD, AMC, AMD, SR, SL, TRF, TRB, TLF, TLB, DO and DC are signs that designate pilot pressures to be applied to the $1^{st}$-$15^{th}$ directional control valves 31-35. These signs have the following meanings:

BMU: A pilot pressure corresponding to extensions of the boom cylinders 207, 307

BMD: A pilot pressure corresponding to retractions of the boom cylinders 207, 307

BKC: A pilot pressure corresponding to extensions of the bucket cylinders 209, 309

BKD: A pilot pressure corresponding to retractions of the bucket cylinders 209, 309

AMC: A pilot pressure corresponding to extensions of the arm cylinders 208, 308

AMD: A pilot pressure corresponding to retractions of the arm cylinders 208, 308

SR: A pilot pressure corresponding to rotations of the swing motors 211, 311 in rightward swinging directions SL: A pilot pressure corresponding to rotations of the swing motors 211, 311 in leftward swinging directions TRF: A pilot pressure corresponding to rotations of the right travel motors 212, 312 in advancing directions TRB: A pilot pressure corresponding to rotations of the right travel motors 212, 312 in reversing directions TLF: A pilot pressure corresponding to rotations of the left travel motors 210, 310 in advancing directions TLB: A pilot pressure corresponding to rotations of the left travel motors 210, 310 in reversing directions DO: A pilot pressure corresponding to a retraction of the open/close cylinder 313

DC: A pilot pressure corresponding to an extension of the open/close cylinder 313

The $1^{st}$-$8^{th}$ variable-displacement hydraulic pumps 11-18 are grouped into a $1^{st}$ pump unit 2 comprised of the $1^{st}$ variable-displacement hydraulic pump 11 and $2^{nd}$ variable-displacement hydraulic pump 12, a $2^{nd}$ pump unit 3 comprised of the $3^{rd}$ variable-displacement hydraulic pump 13 and $4^{th}$ variable-displacement hydraulic pump 14, a $3^{rd}$ pump unit 4 comprised of the $5^{th}$ variable-displacement hydraulic pump 15 and $6^{th}$ variable-displacement hydraulic pump 16, and a $4^{th}$ pump unit 5 comprised of the $7^{th}$ variable-displacement hydraulic pump 17 and $8^{th}$ variable-displacement hydraulic pump 18.

The $1^{st}$-$15^{th}$ directional control valves 21-35 are grouped into a $1^{st}$ valve group 6 comprised of the $1^{st}$-$4^{th}$ directional control valves 21-24, a $2^{nd}$ valve group 7 comprised of the $5^{th}$-$8^{th}$ directional control valves 25-28, a $3^{rd}$ valve group 8 comprised of the $9^{th}$-$11^{th}$ directional control valves 29-31, and a $4^{th}$ valve group 9 comprised of the $12^{th}$-$15^{th}$ directional control valves 32-35.

To these $1^{st}$-$4^{th}$ valve groups 6-9, the $1^{st}$-$4^{th}$ pump units 2-5 are connected, respectively, via lines each of which combines together oils delivered from the two variable-displacement hydraulic pumps that make up the corresponding pump unit, that is, lines 36, 37, 38, 39.

The $1^{st}$, $5^{th}$ and $14^{th}$ directional control valves 21, 25, 34 are arranged such that they can perform selective switching of flow rate and flow direction of pressure oil corresponding to each of an extension and a retraction of the boom cylinder 207 arranged on the backhoe excavator 200 and selective switching of flow rate and flow direction of pressure oil corresponding to each of an extension and a retraction of the boom cylinder 307 arranged on the loader excavator 300.

The $2^{nd}$, $6^{th}$ and $13^{th}$ directional control valves 22, 26, 33 are arranged such that they can perform selective switching of flow rate and flow direction of pressure oil corresponding to each of an extension and a retraction of the bucket cylinder 209 arranged on the backhoe excavator 200 and selective switching of flow rate and flow direction of pressure oil corresponding to each of an extension and a retraction of the bucket cylinder 309 arranged on the loader excavator 300.

The $3^{rd}$ and $7^{th}$ directional control valves 23, 27 are arranged such that they can perform selective switching of flow rate and flow direction of pressure oil corresponding to each of an extension and a retraction of the arm cylinder 208 arranged on the backhoe excavator 200 and selective switching of flow rate and flow direction of pressure oil corresponding to each of an extension and a retraction of the arm cylinder 308 arranged on the loader excavator 300.

The $4^{th}$ directional control valve 24 is arranged such that it can perform selective switching of flow rate and flow direction of pressure oil corresponding to each of rotations in opposite two directions of the left travel motor 210 arranged on the backhoe excavator 200 and selective switching of flow rate and flow direction of pressure oil corresponding to each of rotations in opposite two directions of the left travel motor 310 arranged on the loader excavator 300.

The $8^{th}$ directional control valve 28 is arranged such that it can perform selective switching of flow rate and flow direction of pressure oil corresponding to each of an extension and a retraction of the open/close cylinder 313 arranged on the loader excavator 300.

The $9^{th}$ directional control valve 29 is arranged such that it can perform selective switching of flow rate and flow direction of pressure oil corresponding to each of an extension of the bucket cylinder 209 arranged on the backhoe excavator 200 and an extension of the arm cylinder 208 arranged on the backhoe excavator 200 and selective switching of flow rate and flow direction of pressure oil corresponding to each of an extension of the bucket cylinder 309 arranged on the loader excavator 300 and an extension of the arm cylinder 308 arranged on the loader excavator 300.

The $10^{th}$ directional control valve 30 is arranged such that it can perform selective switching of flow rate and flow direction of pressure oil corresponding to each of rotations in opposite two directions of the swing motor 211 arranged on the backhoe excavator 200 and selective switching of flow rate and flow direction of pressure oil corresponding to each of rotations in opposite two directions of the swing motor 311 arranged on the loader excavator 300.

The $11^{th}$ directional control valve 31 is arranged such that it can perform selective switching of flow rate and flow direction of pressure oil corresponding to only an extension out of the extension and a retraction of the boom cylinder 207 arranged on the backhoe excavator 200 and selective switching of flow rate and flow direction of pressure oil corresponding to only an extension out of the extension and a retraction of the boom cylinder 307 arranged on the loader excavator 300.

The $12^{th}$ directional control valve 32 is arranged such that it can perform selective switching of flow rate and flow direction of pressure oil corresponding to each of rotations in opposite two directions of the right travel motor 212 arranged on the backhoe excavator 200 and selective switching of flow rate and flow direction of pressure oil corresponding to each of rotations in opposite two directions of the right travel motor 312 arranged on the loader excavator 300.

The $15^{th}$ directional control valve 35 is arranged such that it can perform selective switching of flow rate and flow direction of pressure oil corresponding to each of an extension and a retraction of the arm cylinder 208 arranged on the backhoe excavator 200 out of the backhoe excavator 200 and loader excavator 300.

Figure 5:
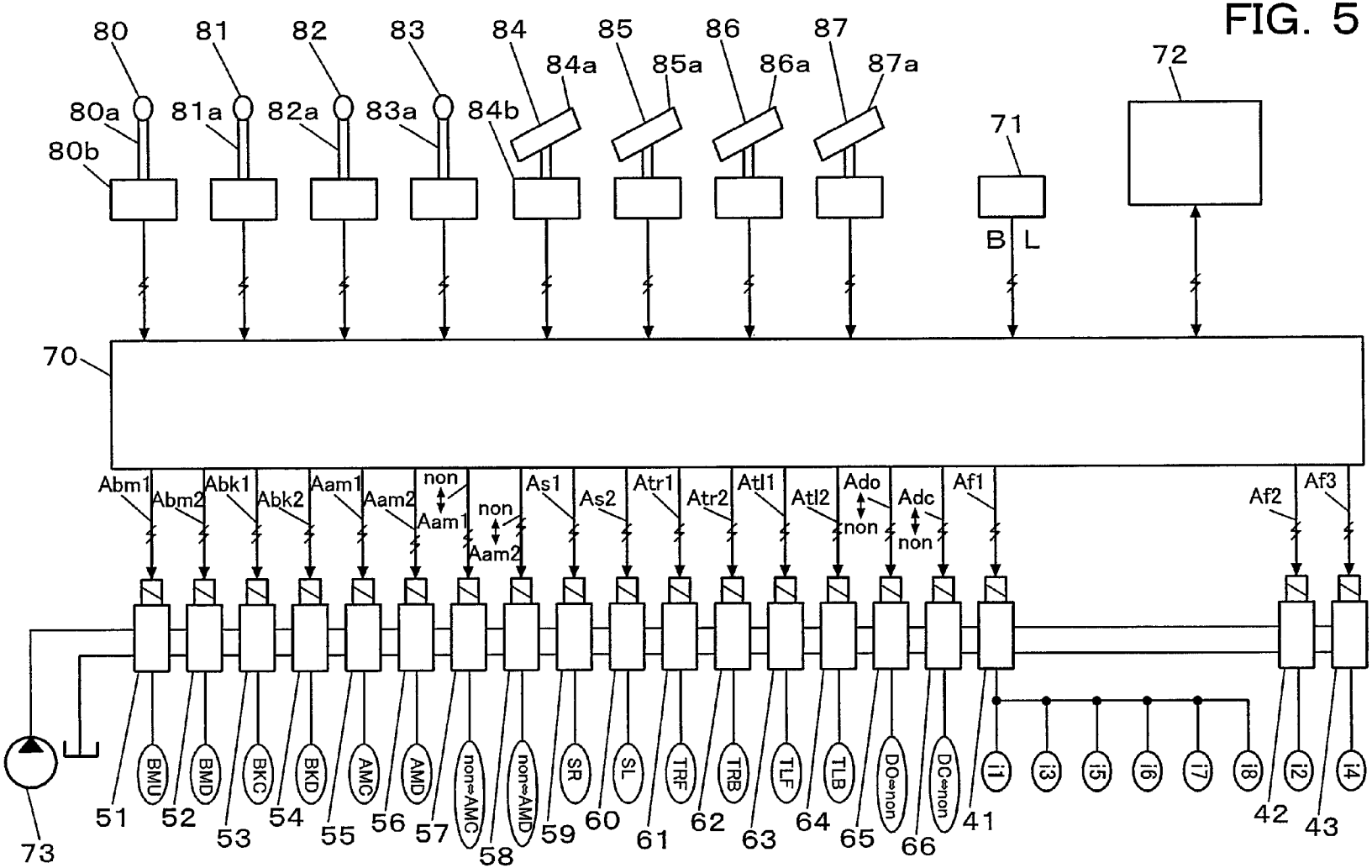
FIG. 5 is a block diagram illustrating a system which the first embodiment is provided with to control the hydraulic circuits shown in FIGS. 3 and 4.

FIG. 5 is a block diagram illustrating a system according to the first embodiment in order to control the hydraulic circuits shown in FIGS. 3 and 4.

In this FIG. 5, designated at 80-87 are control devices all arranged in the operator's cab 203*a* of the backhoe excavator 200 or the operator's cab 303*a* of the loader excavator 303, specifically a boom control lever device 80, a bucket control lever device 81, an arm control lever device 82, a swing control lever device 83, aright travel control pedal device 84, a left travel control pedal device 85, an open control pedal device 86, and a close control pedal device 87. It is to be noted that the open control pedal device 86 and close control pedal device 87 are arranged only in the operator's cab 303*a* of the loader excavator 300.

The boom control level device 80 is provided with a control lever 80*a* arranged pivotally in two opposite directions from a neutral position and an angle detector 80*b* for outputting a control signal (electrical signal) corresponding to a pivot angle (operation direction and operation stroke) of the control lever 80*a*. The control signal indicates a pivot angle of the control lever 80*a* by a voltage value of, for example, from −2.5 to 2.5V. Described specifically, the voltage value of the control signal becomes 0 V when the control lever 80*a* is at the neutral position, becomes a voltage value higher than 0 V, with 2.5 V being the upper limit, when the control lever 80*a* is pivoted in one direction from the neutral position, and becomes a voltage value lower than 0 V, with −2.5 V being the lower limit, when the control lever 80*a* is pivoted in an opposite direction from the neutral position. The bucket control lever device 81, arm control lever device 82 and swing control lever device 83 are also constructed like the boom control lever device 80.

The right travel control pedal device 84 is provided with a control pedal 84*a* arranged pivotally in two opposite directions from a neutral position and an angle detector 84*b* for outputting a control signal (electrical signal) corresponding to a pivot angle (operation direction and operation stroke) of the control pedal 84*a*. The left travel control pedal device 85, open control pedal device 86 and close control pedal device 87 are also constructed like the right travel control pedal device 84. Control signals from these right travel control pedal device 84, left travel control pedal device 85, open control pedal device 86 and close control pedal device 87 are also electrical signals similar to the above-mentioned control signal from the boom control lever device 80.

The first embodiment is provided with $1^{st}$, $2^{nd}$ and $3^{rd}$ flow-rate control solenoid valves 41, 42, 43 arranged such that the pilot pressures i1-i8 can be applied to the pump flow rate control means for controlling the pump flow rates of the respective $1^{st}$-$8^{th}$ variable-displacement hydraulic pumps 11-18, for example, the regulators 11*a*-18*a* for the $1^{st}$-$8^{th}$ variable-displacement hydraulic pumps 11-18. The first embodiment is also provided with a direction control means for controlling the respective $1^{st}$-$15^{th}$ directional control valves 21-35, for example, $1^{st}$-$16^{th}$ directional control solenoid valves 51-66 arranged such that the pilot pressures BMU, BMD, BKC, BKD, AMC, AMD, SR, SL, TRF, TRB, TLF, TLB, DO, DC can be applied to the $1^{st}$-$15^{th}$ directional control valves 21-35. The first embodiment is further provided with a pilot pump 73 as a hydraulic pressure source for the pilot pressures i1-i8 and the pilot pressures BMU, BMD, BKC, BKD, AMC, AMD, SR, SL, TRF, TRB, TLF, TLB, DO, DC. The $1^{st}$, $2^{nd}$ and $3^{rd}$ flow-rate control solenoid valves 41, 42, 43 and the $1^{st}$-$16^{th}$ directional control solenoid valves 51-66 are comprised of proportional solenoid control valves.

The $1^{st}$ flow-rate control solenoid valve 41 is arranged such that pilot pressures can be applied to only the regulators 11*a*, 13*a*, 15*a*, 16*a*, 17*a*, 18*a* for the $1^{st}$, $3^{rd}$, $5^{th}$, $6^{th}$, $7^{th}$ and $8^{th}$ variable-displacement hydraulic pumps 11, 13, 15, 16, 17, 18 out of the regulators 11*a*-18*a* for the $1^{st}$-$8^{th}$ variable-displacement hydraulic pumps 11-18. The $2^{nd}$ flow-rate control solenoid valve 42 is arranged such that a pilot pressure can be applied to only the regulator 12*a* for the $2^{nd}$ variable-displacement hydraulic pump 12 out of the regulators 11*a*-18*a* for the $1^{st}$-$8^{th}$ variable-displacement hydraulic pumps 11-18. The $3^{rd}$ flow-rate control solenoid valve 43 is arranged such that a pilot pressure can be applied to only the regulator 14*a* for the $4^{th}$ variable-displacement hydraulic pump 14 out of the regulators 11*a*-18*a* for the $1^{st}$-$8^{th}$ variable-displacement hydraulic pumps 11-18.

The $1^{st}$ directional control solenoid valve 51 is arranged such that the pilot pressure BMU can be applied to the $1^{st}$, $5^{th}$, $11^{th}$ and $14^{th}$ directional control valves 21, 25, 31, 34. The $2^{nd}$ directional control solenoid valve 52 is arranged such that the pilot pressure BMD can be applied to the $1^{st}$, $5^{th}$ and $14^{th}$ directional control valves 21, 25, 34.

The $3^{rd}$ directional control solenoid valve 53 is arranged such that the pilot pressure BKC can be applied to the $2^{nd}$, $6^{th}$, $9^{th}$ and $13^{th}$ directional control valves 22, 26, 29, 33. The $4^{th}$ direct ional control solenoid valve 54 is arranged such that the pilot pressure BKD can be applied to the $2^{nd}$, $6^{th}$ and $13^{th}$ directional control valves 22, 26, 33.

The $5^{th}$ directional control solenoid valve 55 is arranged such that the pilot pressure AMC can be applied to the $3^{rd}$, $7^{th}$ and $9^{th}$ directional control valves 22, 27, 29. The $6^{th}$ directional control solenoid valve 56 is arranged such that the pilot pressure AMD can be applied to the $3^{rd}$ and $7^{th}$ directional control solenoid valves 23, 27.

The $7^{th}$ directional control solenoid valve 57 is arranged such that the pilot pressure AMC can be applied to the $15^{th}$ directional control valve 35. The $8^{th}$ directional control solenoid valve 58 is arranged such that the pilot pressure AMD can be applied to the $15^{th}$ directional control valve 35.

The $9^{th}$ directional control solenoid valve 59 is arranged such that the pilot pressure SR can be applied to the $10^{th}$ directional control valve 30. The $10^{th}$ directional control solenoid valve 60 is arranged such that the pilot pressure SL can be applied to the $10^{th}$ directional control valve 30.

The $11^{th}$ directional control solenoid valve 61 is arranged such that the pilot pressure TRF can be applied to the $12^{th}$ directional control valve 32. The $12^{th}$ directional control solenoid valve 62 is arranged such that the pilot pressure TRB can be applied to the $12^{th}$ directional control valve 32.

The $13^{th}$ directional control solenoid valve 63 is arranged such that the pilot pressure TLF can be applied to the $4^{th}$ directional control valve 24. The $14^{th}$ directional control solenoid valve 64 is arranged such that the pilot pressure TLB can be applied to the $4^{th}$ directional control valve 24.

The $15^{th}$ directional control solenoid valve 65 is arranged such that the pilot pressure DO can be applied to the $8^{th}$ directional control valve 28. The $16^{th}$ directional control solenoid valve 66 is arranged such that the pilot pressure DC can be applied to the $8^{th}$ directional control valve 28.

The first embodiment is provided with a controller 70 as a regulation means for performing control of the pump flow-rate control means and directional control means in one mode selected from at least two predetermined modes. This controller 70 has a computer, which realizes by electronic control the control of the $1^{st}$, $2^{nd}$ and $3^{rd}$ flow-rate control solenoid valves 41, 42, 43 as the pump flow-rate control means and the $1^{st}$-$16^{th}$ directional control solenoid valves 51-66 as the directional control means. This computer is configured to perform the control of the $1^{st}$, $2^{nd}$ and $3^{rd}$ flow-rate control solenoid valves 41, 42, 43 and $1^{st}$-$15^{th}$ directional control solenoid valves 51-66 in accordance with control signals from the boom control lever device 80, bucket control lever device 81, arm control lever device 82, swing control lever device 83, right travel control pedal device 84, left travel control pedal device 85, open control pedal device 86, and close control pedal device 87.

The first embodiment is provided with a mode instruct ion means 71 for instructing a mode to be selected by the regulation means. This mode instruction means 71 has an electric circuit for generating an electrical signal that instructs the kind of a mode, which is to be selected from at least two kinds of modes, to the computer of the controller 70.

The at least two kinds of modes include three kinds of modes, that is, a backhoe mode, a loader mode and an error mode. The backhoe mode is a mode in which the control of the $1^{st}$, $2^{nd}$ and $3^{rd}$ flow-rate control solenoid valves 41, 42, 43 and $1^{st}$-$16^{th}$ directional control solenoid valves 51-66 is performed to make the hydraulic circuit 1 function as a hydraulic drive circuit for the backhoe excavator. The loader mode is a mode in which the control of the $1^{st}$, $2^{nd}$ and $3^{rd}$ flow-rate control solenoid valves 41, 42, 43 and $1^{st}$-$16^{th}$ direct ional control solenoid valves 51-66 is performed to make the hydraulic circuit 1 function as a hydraulic drive circuit for the loader excavator. The error mode is a mode in which the $1^{st}$, $2^{nd}$ and $3^{rd}$ flow-rate control solenoid valves 41, 42, 43 and the $1^{st}$-$16^{th}$ directional control solenoid valves 51-66 are both controlled to remain inoperative.

The electric circuit of the mode instruction means 71 is provided with a $1^{st}$ signal generation circuit 71*a* for generating a backhoe mode selection signal B (electrical signal) that instructs the selection of the backhoe mode, a $1^{st}$ connector (not shown) capable of turning on/off the $1^{st}$ signal generation circuit 71*a*, a $2^{nd}$ signal generation circuit 71*b* for generating a loader mode selection signal L (electrical signal) that instructs the selection of the loader mode, and a $2^{nd}$ connector (not shown) capable of turning on/off the $2^{nd}$ signal generation circuit 71*b*.

The controller 70 is configured to perform mode setting by performing reading of the backhoe mode selection signal B and loader mode selection signal L only once between power on and power off before the control of the $1^{st}$, $2^{nd}$ and $3^{rd}$ flow-rate control solenoid valves 41, 42, 43 and the $1^{st}$-$16^{th}$ directional control solenoid valves 51-66 are first initiated.

To the controller 70, a display unit 72 is connected. The controller 70 is set to output an instruction signal to the display unit 72 such that the display unit 72 shows the results of reading of the backhoe mode selection signal B and loader mode selection signal L. Therefore, the first embodiment is provided with a display means for showing the results of reading of the backhoe mode selection signal B and loader mode selection signal L. The display unit 72 is arranged in the operator's cab 202*a* of the backhoe excavator 200 or the operator's cab 302*a* of the loader mode 300.

The computer of the controller 70 is configured to set the mode in the error mode when the results of reading of the backhoe mode select ion signal B and loader mode selection signal L are that both the backhoe mode selection signal B and loader mode selection signal L have been read or neither the backhoe mode selection signal B nor the loader mode selection signal L has been read.

Figure 6:
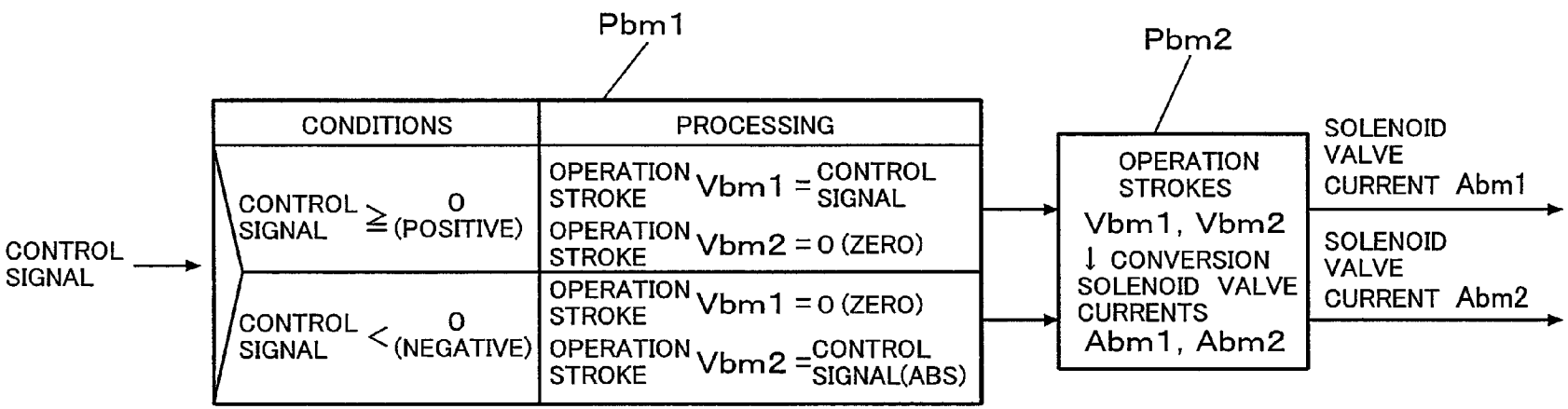
FIG. 6 is a diagram illustrating processing which a controller depicted in FIG. 5 performs to control $1^{st}$ and $2^{nd}$ directional control solenoid valves.

FIG. 6 is a diagram illustrating processing which the controller depicted in FIG. 5 performs to control the $1^{st}$ and $2^{nd}$ directional control solenoid valves.

As illustrated in FIG. 6, the controller 70 is set to perform processing Pbm1, Pbm2 when a control signal is inputted from the boom control lever device 80.

The processing Pbm1 comprises the processing that selectively performs the first or second processing to be described next in (1) and (2).

(1) The first processing is the processing that, when the condition that the voltage value of a control signal is 0 V or higher (control signal≧0 (positive)) is satisfied, the voltage value of the control signal is substituted for the value indicating an operation stroke Vbm1 of the control lever 80*a* upon the pivotal operation of the control lever 80*a* in the one direction from the neutral position (operation stroke Vbm1=control signal, operation stroke Vbm2=0 (zero)).

(2) The second processing is the processing that, when the condition that the voltage value of a control signal is lower than 0 (control signal<0 (negative)) is satisfied, the absolute value (ABS) of the voltage value of the control signal is substituted for the value indicating the operation stroke Vbm2 upon the pivotal operation of the control lever 80*a* in the other direction (the direction opposite to the one direction) from the neutral position (operation stroke Vbm1=0 (zero), operation stroke Vbm2=control signal (ABS)).

The processing Pbm2 consists of a processing that calculates a target control amount for the $1^{st}$ directional control solenoid valve 51, that is, the value of a current (solenoid valve current Abm1) to be applied to the $1^{st}$ directional control solenoid valve 51 on the basis of the value of the operation stroke Vbm1 obtained in the processing Pbm1 and outputs the solenoid valve current Abm1 of the calculated current value, and a processing that calculates a target control amount for the $2^{nd}$ directional control solenoid valve 52, that is, the value of a current (solenoid valve current Abm2) to be applied to the $2^{nd}$ directional control solenoid valve 52 on the basis of the value of the operation stroke Vbm2 obtained in the processing Pbm1 and outputs the solenoid valve current Abm2 of the calculated current value.

The controller 70 is, therefore, set to control the $1^{st}$ directional control solenoid valve 51, which produces the pilot pressure BMU, and the $2^{nd}$ directional control solenoid valve 52, which produces the pilot pressure BMD, by outputting the solenoid valve currents Abm1, Abm2 that correspond to the control signal from the boom control lever device 80.

Processing which the controller 70 performs to control each of the directional control solenoid valves other than the $1^{st}$, $2^{nd}$, $15^{th}$ and $16^{th}$ directional control solenoid valves 51, 52, 65, 66, that is, the $3^{rd}$-$14^{th}$ directional control solenoid valves 53-64 is also set similar to the above-mentioned processing illustrated in FIG. 6. Described specifically, the controller 70 is set to control the $3^{rd}$ directional control solenoid valve 53, which produces the pilot pressure BKC, and the $4^{th}$ directional control solenoid valve 54, which produces the pilot pressure BKD, by outputting solenoid valve currents Abk1, Abk2 that correspond to a control signal from the boom control lever device 80. Further, the controller 70 is set to control the $5^{th}$ and $7^{th}$ directional control solenoid valves 55, 57, which produce the pilot pressure AMC, and the $6^{th}$ and $7^{th}$ directional control solenoid valves 56, 58, which produce the pilot pressure AMD, by outputting solenoid valve currents Aam1, Aam2 that correspond to a control signal from the arm control lever device 82. Furthermore, the controller 70 is set to control the $9^{th}$ directional control solenoid valve 59, which produces the pilot pressure SR, and the $10^{th}$ directional control solenoid valve 60, which produces the pilot pressure SL, by outputting solenoid valve currents As1, As2 that correspond to a control signal from the swing control lever device 83. In addition, the controller 70 is set to control the $11^{th}$ directional control solenoid valve 61, which produces the pilot pressure TRF, and the $12^{th}$ directional control solenoid valve 62, which produces the pilot pressure TRB, by outputting solenoid valve currents Atr1, Atr2 that correspond to a control signal from the right travel control pedal device 84. Moreover, the controller 70 is set to control the $13^{th}$ directional control solenoid valve 63, which produces the pilot pressure TLF, and the $14^{th}$ directional control solenoid valve 64, which produces the pilot pressure TLB, by outputting solenoid valve currents Atl1, Atl2 that correspond to a control signal from the left travel control pedal device 85.

It is to be noted that the controller 70 is set to perform the control of the $7^{th}$ and $8^{th}$ directional control solenoid valves 57, 58 only when the mode is the backhoe mode, in other words, to set both of the solenoid valve current Aam1, which is to be outputted to the $7^{th}$ directional control solenoid valve 57, and the solenoid valve current Aam2, which is to be outputted to the $8^{th}$ directional control solenoid valve 58, at 0 irrespective of the voltage value of the control signal from the arm control lever device 82 when the mode is the loader mode.

Figure 7:
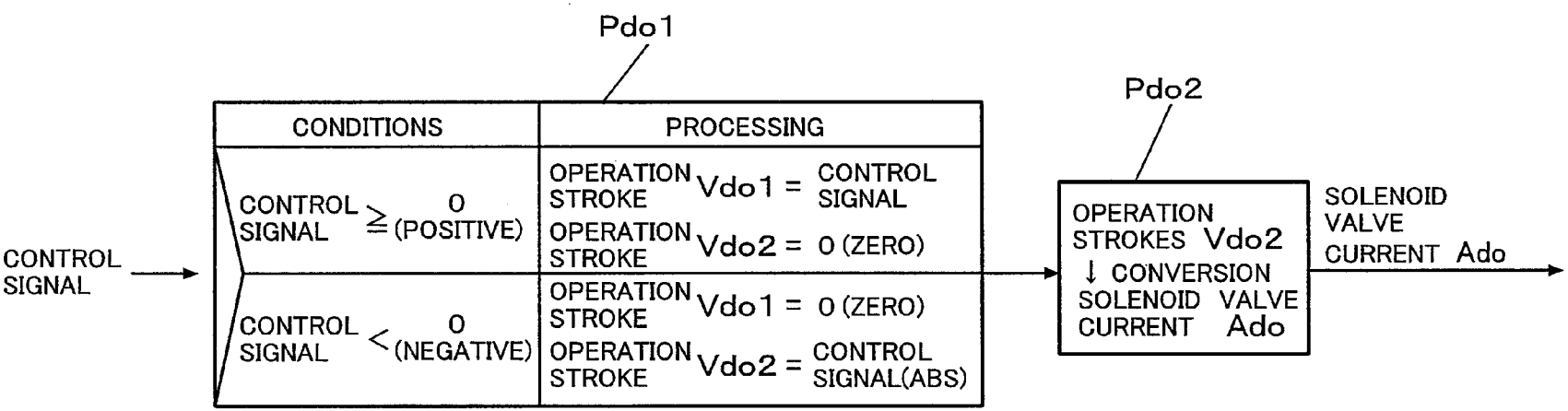
FIG. 7 is a diagram illustrating processing which the controller depicted in FIG. 5 performs to control a $15^{th}$ directional control solenoid valve.

FIG. 7 is a diagram illustrating processing which the controller depicted in FIG. 5 performs to control the $15^{th}$ directional control solenoid valve.

As illustrated in FIG. 7, the controller 70 is set to perform processing Pdo1, Pdo2 when a control signal is inputted from the open control lever device 86.

The processing Pdo1 comprises the processing that selectively performs the first or second processing to be described next in (3) and (4).

(3) The first processing is the processing that, when the condition that the voltage value of a control signal is 0 V or higher (control signal≧0 (positive)) is satisfied, the voltage value of the control signal is substituted for the value indicating the operation stroke Vdo1 of the control pedal 86*a* upon the pivotal operation of the control pedal 86*a* in the one direction from the neutral position (operation stroke Vdo1=control signal, operation stroke Vod2=0 (zero)).

(4) The second processing is the processing that, when the condition that the voltage value of a control signal is lower than 0 (control signal<0 (negative)) is satisfied, the absolute value (ABS) of the voltage value of the control signal is substituted for the value indicating the operation stroke Vdo2 of the control pedal 86*a* upon the pivotal operation of the control pedal 86*a* in the other direction (the direction opposite to the one direction) from the neutral position (operation stroke Vdo1=0 (zero), operation stroke Vdo2=ABS (control signal)).

The processing Pdo2 consists of a processing that calculates a target control amount for the $15^{th}$ directional control solenoid valve 65 to produce the pilot pressure DO, that is, the value of a current (solenoid valve current Ado) to be applied to the $15^{th}$ directional control solenoid valve 65 on the basis of the value of the operation stroke Vdo2 obtained in the processing Pdo1 and outputs the solenoid valve current Ado of the calculated current value.

In other words, the controller 70 is set to control the $15^{th}$ directional control solenoid valve 65 by outputting the solenoid valve current Ado corresponding to only a control signal, specifically the value of the operation stroke Vdo2 when the control pedal 86*a* of the open control pedal device 86 is pivoted in the other direction. Processing which the controller 70 performs to control the $16^{th}$ directional control solenoid valve 66 is set similar to the processing illustrated in FIG. 7. Described specifically, the controller 70 is set to control the $16^{th}$ directional control solenoid valve 66 by outputting a solenoid valve current Adc corresponding to only a control signal when the control pedal 87*a* of the close control pedal device 87 is pivoted in the other direction. As the processing for controlling the $15^{th}$ and $16^{th}$ directional control solenoid valves 65, 66 is set as described above, it is possible to adopt an open control pedal device and a close control pedal device of a construction similar to the right travel control pedal device 84.

Figure 8:
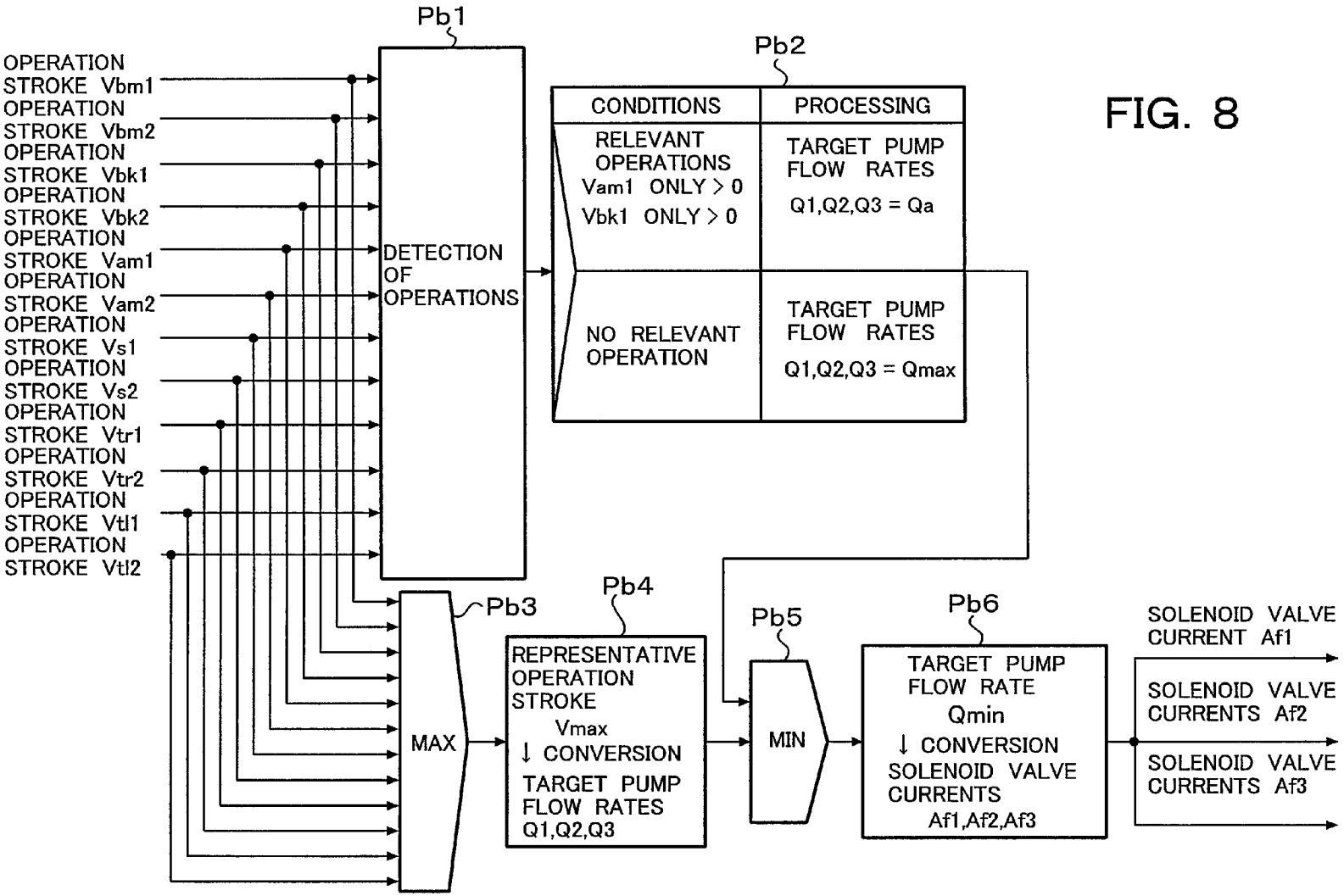
FIG. 8 is a diagram illustrating processing for controlling $1^{st}$, $2^{nd}$ and $3^{rd}$ flow-rate control solenoid valves, said processing being to be performed when the controller depicted in FIG. 5 is in a backhoe mode.

FIG. 8 is a diagram illustrating processing for controlling the $1^{st}$, $2^{nd}$ and $3^{rd}$ flow-rate control solenoid valves, said processing being to be performed when the controller depicted in FIG. 5 is in the backhoe mode.

In this FIG. 8, the operation stroke Vbm1 is the voltage value of a control signal outputted from the boom control lever device 80 when the control lever 80*a* is pivotally operated in the one direction from the neutral position as described using FIG. 6. On the other hand, the operation stroke Vbm2 is the absolute value of the voltage value of a control signal outputted from the boom control lever device 80 when the control lever 80*a* is pivotally operated in the other direction (in the direction opposite to the one direction) from the neutral position.

An operation stroke Vbk1 is the voltage value of a control signal outputted from the bucket control lever device 81 when the control lever 81*a* is pivotally operated in the one direction from the neutral position. An operation stroke Vbk2 indicates the absolute value of the voltage value of a control signal outputted from the bucket control lever device 81 when the control lever 81*a* is pivotally operated in the other direction from the neutral position.

An operation stroke Vam1 is the voltage value of a control signal outputted from the arm control lever device 82 when the control lever 82*a* is pivotally operated in the one direction from the neutral position. An operation stroke Vam2 is the absolute value of the voltage value of a control signal outputted from the arm control lever device 82 when the control lever 82*a* is pivotally operated in the other direction from the neutral position.

An operation stroke Vs1 is the voltage value of a control signal outputted from the swing control lever device 83 when the control lever 83*a* is pivotally operated in the one direction from the neutral position. An operation stroke Vs2 is the absolute value of the voltage value of a control signal outputted from the swing control lever device 83 when the control lever 83*a* is pivotally operated in the other direction from the neutral position.

An operation stroke Vtr1 is the voltage value of a control signal outputted from the right travel control pedal device 84 when the control pedal 84*a* is pivotally operated in the one direction from the neutral position. An operation stroke Vtr2 is the absolute value of the voltage value of a control signal outputted from the right travel control pedal device 84 when the control pedal 84*a* is pivotally operated in the other direction from the neutral position.

An operation stroke Vtl1 is the voltage value of a control signal outputted from the left travel control pedal device 85 when the control pedal 85*a* is pivotally operated in the one direction from the neutral position. An operation stroke Vtl2 is the absolute value of the voltage value of a control signal outputted from the left travel control pedal device 85 when the control pedal 85*a* is pivotally operated in the other direction from the neutral position.

The controller 70 is set to perform processing Pb1-Pb6 shown in FIG. 8 at the time of the backhoe mode.

The processing Pb1 comprises the processing that detects operation of the control lever or control pedal (operation direction and operation stroke) of each of the boom control lever device 80, bucket control lever device 81, arm control lever device 82, swing control lever device 83, right travel control pedal device 84 and left travel control pedal device 85 on the basis of the value of the corresponding one of the operation strokes Vbm1, Vbm2, Vbk1, Vbk2, Vam1, Vam2, Vs1, Vs2, Vtr1, Vtr2, Vtl1, Vtl2.

The processing Pb2 comprises the processing that selectively performs the first, second or third processing to be described next in (5)-(7).

(5) The first processing is the processing that, when the condition that only the operation stroke Vam1 out of the operation strokes Vbm1, Vbm2, Vbk1, Vbk2, Vam1, Vam2, Vs1, Vs2, Vtr1, Vtr2, Vtl1, Vtl2, that is, all the operation strokes is greater than 0 (only Vam1>0) is satisfied, in other words, when the operation detected in the processing Pb1 is an instruction to extend the arm cylinder 208 singly, sets all of the target control amounts of the pump flow rates to be controlled by the respective $1^{st}$, $2^{nd}$ and $3^{rd}$ flow-rate control solenoid valves 41, 42, 43, specifically target pump flow rates Q1, Q2, Q3 at a pump flow rate Qa determined beforehand to be lower than a maximum pump flow rate Qmax (Q1=Qa, Q2=Qa, Q3=Qa).

(6) The second processing is the processing that, when the condition that only the operation stroke Vbk1 out of all the operation strokes is greater than 0 (only Vbk1>0) is satisfied, in other words, when the operation detected in the processing Pb1 is an instruction to extend the bucket cylinder 209 singly, sets all of the target control amounts Q1, Q2, Q3 at Qa (Q1=Qa, Q2=Qa, Q3=Qa).

The target flow rate Qa mentioned in (5) and (6) is a value empirically or experimentally determined for the purposes of inhibiting an excess in the feed flow rate of pressure oil to the arm cylinder 208 when the arm cylinder 208 singly extends, that is, inhibiting an excess in the operation speed of the arm 205 at the time of single arm-crowding operation, and also preventing an excess in the feed flow rate of pressure oil to the bucket cylinder 209 when the bucket cylinder 209 singly extends, that is, inhibiting an excess in the operation speed of the bucket 206 at the time of single bucket-crowding operation.

(7) The third processing is the processing that, when none of the two conditions (only Vam1>0, only Vbk1>0) mentioned above in (5) and (6) are satisfied, in other words, when the operation detected in the processing Pb1 is neither an instruction to extend the arm cylinder 208 singly nor an instruction to extend the bucket cylinder 209 singly, sets all of the target control amounts Q1, Q2, Q3 at the maximum pump flow rate Qmax (Q1=Qmax, Q2=Qmax, Q3=Qmax).

The processing Pb3 comprises the processing that selects the largest operation stroke (representative operation stroke Vmax) from all the operation strokes.

The processing Pb4 comprises the processing that calculates the target pump flow rates Q1, Q2, Q3 corresponding to the representative operation stroke Vmax obtained in the processing Pb3. Described specifically, functions that indicate correlations between the representative operation stroke Vmax and the target pump flow rates Q1, Q2, Q3 are stored beforehand in the controller 70, and the controller 70 is set such that the representative operation stroke Vmax is converted into the target pump flow rates Q1, Q2, Q3 by using the functions.

The processing Pb5 comprises the processing that compares the target pump flow rates (Q1=Qa, Q2=Qa, Q3=Qa, or Q1=Qmax, Q2=Qmax, Q3=Qmax) set in the processing Pb2 with the target pump flow rates calculated in the processing Pb4 and selects the lower target pump flow rate.

The processing Pb6 comprises the processing that calculates the values of respective solenoid valve currents Af1, Af2, Af3 of the 1$^{st}$, 2$^{nd}$ and 3$^{rd}$ flow-rate control solenoid valves 41, 42, 43, said solenoid valve currents corresponding to a target pump flow rate Qmin after the minimum comparison as selected in the processing Pb5, and outputs all of the solenoid valve currents Af1, Af2, Af3 of the calculated current values. Described specifically, functions that indicate correlations between the target pump flow rates Q1, Q2, Q3 and the solenoid valve currents Af1, Af2, Af3 are stored beforehand in the controller 70, and the controller 70 is set such that the representative target pump flow rates selected as the target pump flow rate Qmin are converted into their corresponding solenoid valve currents Af1, Af2, Af3 by using the functions.

FIGS. 9-1 is a diagram illustrating processing for controlling the 1$^{st}$ flow-rate control solenoid valve, said processing being performed when the controller depicted in FIG. 5 is in the loader mode, FIGS. 9-2 is a diagram illustrating processing for controlling the 2$^{nd}$ flow-rate control solenoid valve, said processing being performed when the controller depicted in FIG. 5 is in the loader mode, and FIGS. 9-3 is a diagram illustrating processing for controlling the 3$^{rd}$ flow-rate control solenoid valve, said processing being performed when the controller depicted in FIG. 5 is in the loader mode.

In these FIGS. 9-1, 9-2 and 9-3, an operation stroke Vdo2 is the absolute value of the voltage value of a control signal outputted from the open control pedal device 86 when the control pedal 86*a* is pivotally operated in the other direction from the neutral position as described using FIG. 7. On the other hand, an operation stroke Vdc2 is the absolute value of the voltage value of a control signal outputted from the close control pedal device 87 when the control pedal 87*a* is pivotally operated in the other direction from the neutral position.

The controller 70 is set to perform processing Pl1-Pl6 shown in FIGS. 9-1 at the time of the loader mode.

The processing Pl1 comprises the processing that detects operation of the control lever or control pedal (operation direction and operation stroke) of each of the boom control lever device 80, bucket control lever device 81, arm control lever device 82, swing control lever device 83, right travel control pedal device 84, left travel control pedal device 85, open control pedal device 86 and close control pedal device 87 on the basis of the value of the corresponding one of the operation strokes Vbm1, Vbm2, Vbk1, Vbk2, Vam1, Vam2, Vs1, Vs2, Vtr1, Vtr2, Vtl1, Vtl2, Vdo2, Vdc2.

The processing P12 comprises the processing that selectively performs the first to tenth processing to be described next in (8)-(17).

(8) The first processing is the processing that, when the condition that only the operation stroke Vam1 out of the operation strokes Vbm1, Vbm2, Vbk1, Vbk2, Vam1, Vam2, Vs1, Vs2, Vtr1, Vtr2, Vt11, Vtl2, Vdo2, Vdc2, that is, all the operation strokes is greater than 0 (only Vam1>0) is satisfied, in other words, when the operation detected in the processing Pl1 is an instruction to extend the arm cylinder 308 singly, sets the target control amount of the pump flow rates to be controlled by the 1$^{st}$ flow-rate control solenoid valve 41, specifically the target pump flow rate Q1 at a target pump flow rate Qb determined beforehand to be lower than the maximum pump flow rate Qmax (Q1=Qb).

(9) The second processing is the processing that, when the condition that only the operation stroke Vbk1 out of all the operation strokes is greater than 0 (only Vbk1>0) is satisfied, in other words, when the operation detected in the processing Pl1 is an instruction to extend the bucket cylinder 309 singly, sets the target pump flow rate Q1 at Qb (Q1=Qb).

(10) The third processing is the processing that, when the condition that only the operation strokes Vbk1, Vam1 out of all the operation strokes are greater than 0 (only Vbk1, Vam1>0) is satisfied, in other words, when the operation detected in the processing Pl1 is an instruction to extend the bucket cylinder 309 and to extend the arm cylinder 308 at the same time, sets the target pump flow rate Q1 at Qb (Q1=Qb).

(11) The fourth processing is the processing that, when the condition that only the operation strokes Vbk1, Vam2 out of all the operation strokes are greater than 0 (only Vbk1, Vam2>0) is satisfied, in other words, when the operation detected in the processing Pl1 is an instruction to extend the bucket cylinder 309 and to retract the arm cylinder 308 at the same time, sets the target pump flow rate Q1 at Qb (Q1=Qb).

(12) The fifth processing is the processing that, when the condition that only the operation strokes Vbk2, Vam1 out of all the operation strokes are greater than 0 (only Vbk2, Vam1>0) is satisfied, in other words, when the operation detected in the processing Pl1 is an instruction to retract the bucket cylinder 309 and to extend the arm cylinder 308 at the same time, sets the target pump flow rate Q1 at Qb (Q1=Qb).

(13) The sixth processing is the processing that, when the condition that only the operation strokes Vbm1, Vam1 out of all the operation strokes are greater than 0 (only Vbm1, Vam1>0) is satisfied, in other words, when the operation detected in the processing Pl1 is an instruction to extend the boom cylinder 307 and to extend the arm cylinder 308 at the same time, sets the target pump flow rate Q1 at Qb (Q1=Qb).

(14) The seventh processing is the processing that, when the condition that only the operation strokes Vbm2, Vam1 out of all the operation strokes are greater than 0 (only Vbm2, Vam1>0) is satisfied, in other words, when the operation detected in the processing Pl1 is an instruction to retract the boom cylinder 307 and to extend the arm cylinder 308 at the same time, sets the target pump flow rate Q1 at Qb (Q1=Qb).

(15) The eighth processing is the processing that, when the condition that only the operation strokes Vam1, Vdo2 out of all the operation strokes are greater than 0 (only Vam1, Vdo2>0) is satisfied, in other words, when the operation detected in the processing Pl1 is an instruction to extend the arm cylinder 308 and to retract the open/close cylinder 313 at the same time, sets the target pump flow rate Q1 at Qb (Q1=Qb).

(16) The ninth processing is the processing that, when the condition that only the operation strokes Vam1, Vdc2 out of all the operation strokes are greater than 0 (only Vam1, Vdc2>0) is satisfied, in other words, when the operation detected in the processing Pl1 is an instruction to extend the arm cylinder 308 and to extend the open/close cylinder 313 at the same time, sets the target pump flow rate Q1 at Qb (Q1=Qb).

The target flow rate Qb mentioned in (10) to (16) is a value empirically or experimentally determined for the purposes of inhibiting an excess in the operation speed of the arm 305 at the time of single arm-crowding operation (when only the arm cylinder 308 extends), inhibiting an excess in the operation speed of the bucket 306 at the time of single bucket-tilting operation (when only the bucket cylinder 309 extends), and also preventing excess(es) in the operation speed(s) of the boom 305, arm 306 and/or bucket 307 and/or an excess in the open/close speed of the bucket 306 at the time of specific combined operation of the front working assembly 303.

(17) The tenth processing is the processing that, when none of the nine conditions mentioned above in (8) to (16) are satisfied, sets the target pump flow rate Q1 at the maximum pump flow rate Qmax (Q1=Qmax).

The processing P13 comprises the processing that selects the largest operation stroke (representative operation stroke Vmax1) from all the operation strokes.

The processing P14 comprises the processing that calculates the target pump flow rate Q1 corresponding to the representative operation stroke Vmax1 obtained in the processing Pbl3. Described specifically, a function that indicates a correlation between the representative operation stroke Vmax1 and the target pump flow rate Q1 is stored beforehand in the controller 70, and the controller 70 is set such that the representative operation stroke Vmax1 is converted into the target pump flow rate Q1 by using the function.

The processing Pbl5 comprises the processing that compares the target pump flow rate (Q1=Qb or Q1=Qmax) set in the processing Pbl2 with the target pump flow rate Q1 calculated in the processing Pbl4 and selects the lower target pump flow rate.

The processing Pbl6 comprises the processing that calculates the value of the solenoid valve current Af1 of the $1^{st}$ flow-rate control solenoid valve 41, said solenoid valve current corresponding to the target pump flow rate Qmin1 after the minimum comparison as selected in the processing P15. Described specifically, a function that indicates a correlation between the target pump flow rate Q1 and the solenoid valve current Af1 is stored beforehand in the controller 70, and the controller 70 is set such that the target pump flow rate Q1 is converted into the solenoid valve current Af1 by using the function.

The controller 70 is set to perform processing Pl7-Pl11 shown in FIGS. 9-2 at the time of the loader mode.

The processing P17 comprises the processing that sets the target control amount of the pump flow rate controlled by the $2^{nd}$ flow rate control solenoid valve 42, namely the target pump flow rate Q2 at Qb or Qmax by performing similar processing as in the above-mentioned second processing Pl2 (Q2=Qb or Q2=Qmax).

The processing P18 comprises the processing that selects the largest operation stroke (representative operation stroke Vmax2) from all the operation strokes other than the operation strokes Vbk2, Vam2, Vs1, Vs2.

The processing P19 comprises the processing that calculates the target pump flow rate Q2 corresponding to the representative operation stroke Vmax2 obtained in the processing Pbl8. Described specifically, a function that indicates a correlation between the representative operation stroke Vmax2 and the target pump flow rate Q2 is stored beforehand in the controller 70, and the controller 70 is set such that the representative operation stroke Vmax2 is converted into the target pump flow rate Q2 by using the function.

The processing Pbl10 comprises the processing that compares the target pump flow rate (Q2=Qb or Q2=Qmax) set in the processing Pbl7 with the target pump flow rate Q2 calculated in the processing Pbl9 and selects the lower target pump flow rate.

The processing Pbl11 comprises the processing that calculates the value of the solenoid valve current Af2 of the $2^{nd}$ flow-rate control solenoid valve 42, said solenoid valve current corresponding to the target pump flow rate Qmin2) after the minimum comparison as selected in the processing Pl10, and outputs the solenoid valve current Af2 of the calculated current value. Described specifically, a function that indicates a correlation between the target pump flow rate Q2 and the solenoid valve current Af2 is stored beforehand in the controller 70, and the controller 70 is set such that the target pump flow rate Q2 is converted into the solenoid valve current Af2 by using the function.

The controller 70 is set to perform processing Pl2-Pl16 shown in FIGS. 9-3 at the time of the loader mode.

The processing Pl12 comprises the processing that sets the target control amount of the pump flow rate controlled by the $3^{rd}$ flow rate control solenoid valve 43, namely the target pump flow rate Q3 at Qb or Qmax by performing similar processing as in the above-mentioned second processing P12 (Q3=Qb or Q3=Qmax).

The processing P113 comprises the processing that selects the largest operation stroke (representative operation stroke Vmax3) from all the operation strokes other than the operation strokes Vam2, Vs1, Vs2.

The processing Pl14 comprises the processing that calculates the target pump flow rate Q3 corresponding to the representative operation stroke Vmax3 obtained in the processing Pbl13. Described specifically, a function that indicates a correlation between the representative operation stroke Vmax3 and the target pump flow rate Q3 is stored beforehand in the controller 70, and the controller 70 is set such that the representative operation stroke Vmax3 is converted into the target pump flow rate Q3 by using the function.

The processing Pbl15 comprises the processing that compares the target pump flow rate (Q3=Qb or Q3=Qmax) set in the processing Pbl12 with the target pump flow rate Q3 calculated in the processing Pbl14 and selects the lower target pump flow rate (Qmin3).

The processing Pbl16 comprises the processing that calculates the value of the solenoid valve current Af3 of the $3^{rd}$ flow-rate control solenoid valve 43, said solenoid valve current corresponding to the target pump flow rate Qmin3 after the minimum comparison as selected in the processing Pl15. Described specifically, a function that indicates a correlation between the target pump flow rate Q3 and the solenoid valve current Af3 is stored beforehand in the controller 70, and the controller 70 is set such that the target pump flow rate Q3 is converted into the solenoid valve current Af3 by using the function.

FIGS. 10-1 is a flowchart illustrating a routine when the controller depicted in FIG. 5 controls the $1^{st}$, $2^{nd}$ and $3^{rd}$ flow-rate control solenoid valves and $1^{st}$-$16^{th}$ directional control solenoid valves, FIGS. 10-2 is a continuation of the flowchart illustrated in FIGS. 10-1, and FIG. 11 shows diagrams which illustrate relations between the states of the $1^{st}$ and $2^{nd}$ signal generation circuits and the details shown on the display unit. Using these FIGS. 10-1, 10-2 and 11, operation of the first embodiment will be described.

[Backhoe Mode]

A description will be made about operation when the first embodiment is mounted on the backhoe excavator 200.

In this case, the mode instruction means 71 is arranged on the backhoe excavator 200, with the $1^{st}$ connector being connected and the $2^{nd}$ connector being disconnected.

When the controller 70 is powered on, the controller is set in a predetermined initial state, specifically is initialized (step S1), and then reads a mode selection signal (step S2), as illustrated in FIGS. 10-1. As the $1^{st}$ connector and $2^{nd}$ connector are now in the connected state and disconnected state, respectively, in the mode instruction means 71, the results of the reading of the mode selection signal by the controller 70 become the results that the backhoe mode selection signal B is ON and the loader mode selection signal L is OFF ("YES" in step S3). The controller 70 which has obtained the results sets the mode setting value at a value predetermined corresponding to the backhoe mode (step S5).

Figure 11A:
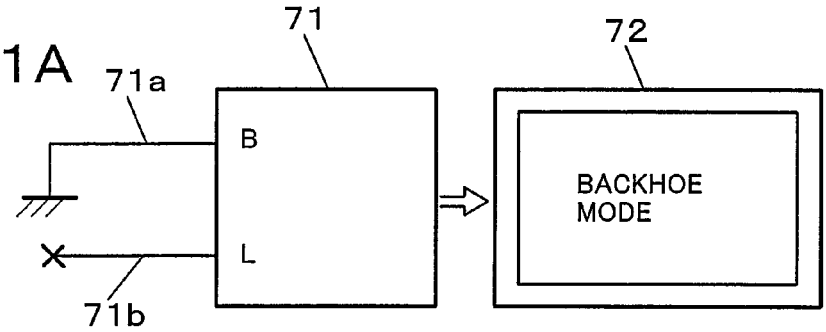
FIG. 11 are diagrams illustrating relations between the states of the $1^{st}$ and $2^{nd}$ signal generation circuits and details shown on a display unit.

Further, the controller 70 outputs, to the display unit 72, an instruction signal for displaying the results of the reading of the backhoe mode selection signal and loader mode selection signal L, specifically the results that only the backhoe mode selection signal B has been read. As a consequence, the display unit 72 shows an image notifying the results that only the backhoe mode selection signal B has been read, in other words, that the mode is to be set this time in the backhoe mode as illustrated in FIG. 11A.

As shown in FIGS. 10-2, the controller 70 next performs input processing of control signal (s) (step S8). As a consequence, operation stroke (s) Vbm1, Vbm2, Vbk1, Vbk2, Vam1, Vam2, Vs1, Vs2, Vtr1, Vtr2, Vtl1 and/or Vtl2 is (are) obtained from control signal (s) of the boom control lever device 80, bucket control lever device 81, arm control lever device 82, swing control lever device 83, right travel control pedal device 84 and/or left travel control pedal device 85. It is to be noted that the open control pedal device 86 and close control pedal device 87 are arranged on the loader excavator 300 and neither a control signal from the open control pedal device 86 nor a control signal from the close control pedal device 87 is input into the controller 70 at the present time.

The controller 70 then determines the currently-set mode from the mode setting value when any one of the operation strokes Vbm1, Vbm2, Vbk1, Vbk2, Vam1, Vam2, Vs1, Vs2, Vtr1, Vtr2, Vtl1, Vtl2 is greater than 0, in other words, upon detection of operation of at least one of the boom control lever device 80, bucket control lever device 81, arm control lever device 82, swing control lever device 83, right travel control pedal device 84 and left travel control pedal device 85 (step S9). The mode is determined to be the backhoe mode at the present time.

The controller 70 next determines the current values of the solenoid valve currents Abm1, Abm2, Abk1, Abk2, Aam1, Aam2, As1, As2, Atr1, Atr2, Atl1, Atl2 corresponding to the respective operation strokes Vbm1, Vbm2, Vbk1, Vbk2, Vam1, Vam2, Vs1, Vs2, Vtr1, Vtr2, Vtl1, Vtl2 (step S10).

The controller 70 also calculates the current values of the respective solenoid valve currents Af1, Af2, Af3 on the basis of the operation strokes Vbm1, Vbm2, Vbk1, Vbk2, Vam1, Vam2, Vs1, Vs2, Vtr1, Vtr2, Vtl1, Vtl2 as described using FIG. 8 (step S10).

The controller 70 next performs output processing of the solenoid valve currents Abm1, Abm2, Abk1, Abk2, Aam1, Aam2, As1, As2, Atr1, Atr2, Atl1, Atl2 (step S13).

As a consequence, one or more of the solenoid valve currents Abm1, Abm2, Abk1, Abk2, Aam1, Aam2, As1, As2, Atr1, Atr2, Atl1, Atl2, said one or more solenoid valve currents having current values greater than 0, are applied to the corresponding one or ones of the $1^{st}$-$16^{th}$ directional control solenoid valves 51-66 other than the $15^{th}$ and $16^{th}$ directional control solenoid valves 65, 66, specifically the $1^{st}$-$14^{th}$ directional control solenoid valves 51-64.

In the one or ones of the $1^{st}$-$14^{th}$ directional control solenoid valves 51-64, to which the corresponding solenoid valve currents have been applied, the valve position or positions of its or their main valves are switched, and as a consequence, pilot pressure(s) is(are) produced. The pilot pressure(s) is (are) applied to the corresponding one or ones of the $1^{st}$-$15^{th}$ directional control valves 21-35 other than the $8^{th}$ directional control valve 28, namely the $1^{st}$-$7^{th}$, $9^{th}$-$15^{th}$ directional control valves 21-27, 29-35 in the hydraulic circuit 1.

Described specifically, in the backhoe mode, the $1^{st}$-$7^{th}$, $9^{th}$-$15^{th}$ directional control valves 21-27, 29-35 out of the $1^{st}$-$15^{th}$ directional control valves 21-35 are controlled in accordance with operation of the boom control lever device 80, bucket control lever device 81, arm control lever device 82, swing control lever device 83, right travel control pedal device 84 and left travel control pedal device 85, and the $8^{th}$ directional control valve 28 does not operate.

The controller 70 also performs output processing of the solenoid valve currents Af1, Af2, Af3 (step s13).

As a consequence, the solenoid valve currents Af1, Af2, Af2 are applied to the $1^{st}$, $2^{nd}$ and $3^{rd}$ flow-rate control solenoid valves 41, 42, 43. As a result, the pilot pressures i1, i3, i5, i6, i7, i8 are applied from the $1^{st}$ flow-rate control solenoid valve 41 to the regulators 11*a*, 13*a*, 15*a*, 16*a*, 17*a*, 18*a* for the $1^{st}$, $3^{rd}$, $5^{th}$, $6^{th}$, $7^{th}$ and $8^{th}$ variable-displacement hydraulic pumps 11, 13, 15, 16, 17, 18, respectively, the pilot pressure i2 is applied from the $2^{nd}$ flow-rate control solenoid valve 42 to the regulator 12*a* for the $2^{nd}$ variable-displacement hydraulic pump 12, and the pilot pressure i4 is applied from the $3^{rd}$ flow-rate control solenoid valve 43 to the regulator 14*a* for the $4^{th}$ variable-displacement hydraulic pump 14.

As described using FIG. 8, the solenoid valve currents Af1, Af2, Af3 are all set at the same current value. Therefore, the pilot pressures i1, i3, i5, i6, i7, i8 produced by the $1^{st}$ flow-rate control solenoid valve 41, the pilot pressure i2 produced by the 2' variable-displacement hydraulic pump 42 and the pilot pressure i4 produced by the $3^{rd}$ variable-displacement hydraulic pump 43 take the same pressure value. Namely, in the backhoe mode, the specification (the flow rates required for driving the backhoe excavator) of the backhoe excavator is met by evenly controlling the pump flow rates of all the $1^{st}$-$8^{th}$ variable-displacement hydraulic pumps 11-18 in accordance with the operation of the boom control lever device 80, bucket control lever device 81, arm control lever device 82, swing control lever device 83, right travel control pedal device 84 and left travel control pedal device 85.

Subsequent to the completion of the output processing, the controller 70 causes the routine to return to step S8 (step S13→step S8).

As a result of the performance of the control of the valve positions of the respective 1st-$7^{th}$ and $9^{th}$-$15^{th}$ directional control valves 21-27, 29-35 out of the $1^{st}$-$15^{th}$ directional control valves 21-35 and the performance of the control of the pump flow rates of all the $1^{st}$-$8^{th}$ variable-displacement hydraulic pumps 11-18 to the even value as described above, the hydraulic circuit 1 functions as a first hydraulic drive circuit for backhoe excavator.

[Loader Mode]

A description will be made about operation when the first embodiment is mounted on the loader excavator 300. In this case, the mode instruction means 71 is arranged on the loader excavator 300, with the $1^{st}$ connector being disconnected and the $2^{nd}$ connector being connected.

When the controller 70 is powered on, the controller is set in a predetermined initial state, specifically is initialized (step S1), and then reads a mode selection signal (step S2), as illustrated in FIGS. 10-1. As the $1^{st}$ connector and $2^{nd}$ connector are now in the disconnected state and connected state, respectively, in the mode instruction means 71, the results of the reading of the mode selection signal by the controller 70 become the results that the backhoe mode selection signal B is OFF and the loader mode selection signal L is ON ("NO" in step S3→"YES" in step S4). The controller 70 which has obtained the results sets the mode setting value at a value predetermined corresponding to the loader mode (step S6).

Figure 11B:
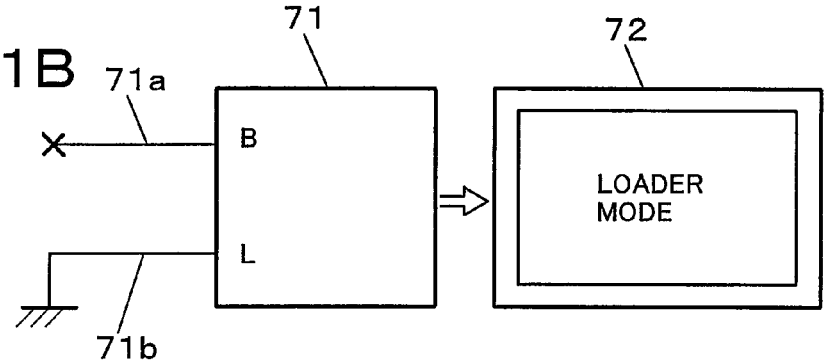

Further, the controller 70 outputs, to the display unit 72, an instruction signal for displaying the results of the reading of the backhoe mode selection signal B and loader mode selection signal L, specifically the results that only the loader mode selection signal L has been read. As a consequence, the display unit 72 shows an image of details corresponding to the result that only the loader mode selection signal L has been read, in other words, an image to the effect that the mode is to be set in the loader mode as illustrated in FIG. 11B.

As shown in FIGS. 10-2, the controller 70 next performs input processing of control signal (s) (step S8). As a consequence, operation stroke (s) Vbm1, Vbm2, Vbk1, Vbk2, Vam1, Vam2, Vs1, Vs2, Vtr1, Vtr2, Vtl1, Vtl2, Vdo2 and/or Vdc2 is (are) obtained from control signal (s) of the boom control lever device 80, bucket control lever device 81, arm control lever device 82, swing control lever device 83, right travel control pedal device 84, left travel control pedal device 85, open control pedal device 86 and/or close control pedal device 87.

The controller 70 then determines the currently-set mode from the mode setting value when any one of the operation strokes Vbm1, Vbm2, Vbk1, Vbk2, Vam1, Vam2, Vs1, Vs2, Vtr1, Vtr2, Vtl1, Vtl2, Vdo2, Vdc2 is greater than 0, in other words, upon detection of operation of at least one of the boom control lever device 80, bucket control lever device 81, arm control lever device 82, swing control lever device 83, right travel control pedal device 84, left travel control pedal device 85, open control pedal device 86 and close control pedal device 87 (step S9). The mode is determined to be the loader mode at the present time.

The controller 70 next determines the current values of the solenoid valve currents Abm1, Abm2, Abk1, Abk2, Aam1, Aam2, As1, As2, Atr1, Atr2, Atl1, Atl2, Ado, Adc corresponding to the respective operation strokes Vbm1, Vbm2, Vbk1, Vbk2, Vam1, Vam2, Vs1, Vs2, Vtr1, Vtr2, Vtl1, Vtl2, Vdo2, Vdc2 as described using FIG. 6 (step S11).

The controller 70 also calculates the current values of the respective solenoid valve currents Af1, Af2, Af3 on the basis of the operation strokes Vbm1, Vbm2, Vbk1, Vbk2, Vam1, Vam2, Vs1, Vs2, Vtr1, Vtr2, Vtl1, Vtl2, Vdo2, Vdc2 as described using FIGS. 9-1, 9-2 and 9-3 (step S11).

The controller 70 next performs output processing of the solenoid valve currents Abm1, Abm2, Abk1, Abk2, Aam1, Aam2, As1, As2, Atr1, Atr2, Atl1, Atl2, Ado, Adc (step S13).

As a consequence, one or more of the solenoid valve currents Abm1, Abm2, Abk1, Abk2, Aam1, Aam2, As1, As2, Atr1, Atr2, Atl1, Atl2, Ado, Adc, said one or more solenoid valve currents having current values greater than 0, are applied to the corresponding one or ones of the $1^{st}$-$16^{th}$ directional control solenoid valves 51-66 other than the $7^{th}$ and $8^{th}$ directional control solenoid valves 57, 58, specifically the $1^{st}$-$6^{th}$ and $9^{th}$-$16^{th}$ directional control solenoid valves 51-56, 59-66.

In the one or ones of the 1st-$6^{th}$ and $9^{th}$-$16^{th}$ directional control solenoid valves 51-56, 59-66, to which the corresponding solenoid valve currents have been applied, the valve position or positions of its or their main valves are switched, and as a consequence, pilot pressure (s) is (are) produced. The pilot pressure (s) is (are) applied to the corresponding one or ones of the $1^{st}$-$15^{th}$ directional control valves 21-35 other than the $15^{th}$ directional control valve 35, namely the $1^{st}$-$14^{th}$ directional control valves 21-34 in the hydraulic circuit 1.

Described specifically, in the loader mode, the $1^{st}$-$14^{th}$ directional control valves 21-34 are controlled in accordance with operation (operation directions and operation strokes) of the boom control lever device 80, bucket control lever device 81, arm control lever device 82, swing control lever device 83, right travel control pedal device 84, left travel control pedal device 85, open control pedal device 86 and close control pedal device 87, and the $15^{th}$ directional control valve 35 does not operate.

The controller 70 also performs output processing of the solenoid valve currents Af1, Af2, Af3 (step s13).

As a consequence, the solenoid valve currents Af1, Af2, Af2 are applied to the $1^{st}$, $2^{nd}$ and $3^{rd}$ flow rate control solenoid valves 41, 42, 43. As a result, the pilot pressures i1, i3, i5, i6, i7, i8 are applied from the $1^{st}$ flow-rate control solenoid valve 41 to the regulators 11*a*, 13*a*, 15*a*, 16*a*, 17*a*, 18*a* for the $1^{st}$, $3^{rd}$, $5^{th}$, $6^{th}$, $7^{th}$ and $8^{th}$ variable-displacement hydraulic pumps 11, 13, 15, 16, 17, 18, respectively, the pilot pressure i2 is applied from the $2^{nd}$ flow-rate control solenoid valve 42 to the regulator 12*a* for the $2^{nd}$ variable-displacement hydraulic pump 12, and the pilot pressure i4 is applied from the $3^{rd}$ flow-rate control solenoid valve 43 to the regulator 14*a* for the $4^{th}$ variable-displacement hydraulic pump 14.

As described using FIGS. 9-1, 9-2 and 9-3, the current values of the respective solenoid valve currents Af1, Af2, Af3 in the loader mode are separately set. Therefore, the pilot pressures i1, i3, i5, i6, i7, i8 produced by the $1^{st}$ flow-rate control solenoid valve 41, the pilot pressure i2 produced by the $2^{nd}$ variable-displacement hydraulic pump 12 and the pilot pressure i4 produced by the $3^{rd}$ variable-displacement hydraulic pump 43 are also set separately. Namely, in the loader mode, the specification (the flow rates required for driving the loader excavator) of the loader excavator is met by individually controlling the pump flow rates of all the $1^{st}$, $3^{rd}$, $5^{th}$, $5^{th}$, $7^{th}$ and $8^{th}$ variable-displacement hydraulic pumps 11, 13, 15-18, the pump flow rate of the $2^{nd}$ variable-displacement hydraulic pump 12 and the pump flow rate of the $4^{th}$ variable-displacement hydraulic pump 14.

Subsequent to the completion of the output processing, the controller 70 causes the routine to return to step S8 (step S13-4 step S8).

As a result of the performance of the control of the valve positions of the respective $1^{st}$-$14^{th}$ directional control valves 21-34 out of the $1^{st}$-$15^{th}$ directional control valves 21-35 and the performance of the individual control of the pump flow rates of all the $1^{st}$, $3^{rd}$, $5^{th}$, $6^{th}$, $7^{th}$ and $8^{th}$ variable-displacement hydraulic pumps 11, 13, 15, 16, 17, 18, the pump flow rate of the $2^{nd}$ variable-displacement hydraulic pump 12 and the pump flow rate of the $4^{th}$ variable-displacement hydraulic pump 14 as described above, the hydraulic circuit 1 functions as a second hydraulic drive circuit for loader excavator.

[Error Mode]

When there is a disconnection (including the situation that the first and second connectors are both disconnected) or a short-circuit (including the situation that the first connector and the second connector are both connected) between the mode instruction means 71 and the controller 70, there are obtained in step S2 the determination results that the backhoe mode selection signal B and the loader mode selection signal L are both OFF or the determination results that the backhoe mode selection signal B and the loader mode selection signal L are both ON ("NO" in step S3→"NO" in step S4). The controller 70 which has obtained the determination results sets the mode setting value at a value predetermined corresponding to the error mode (step S7).

Figure 11C:
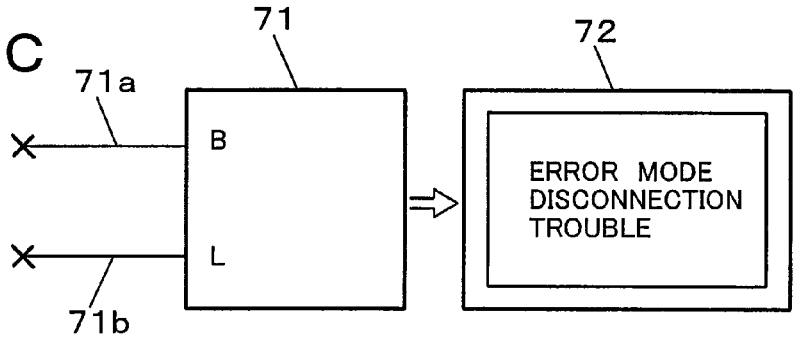
Figure 11D:
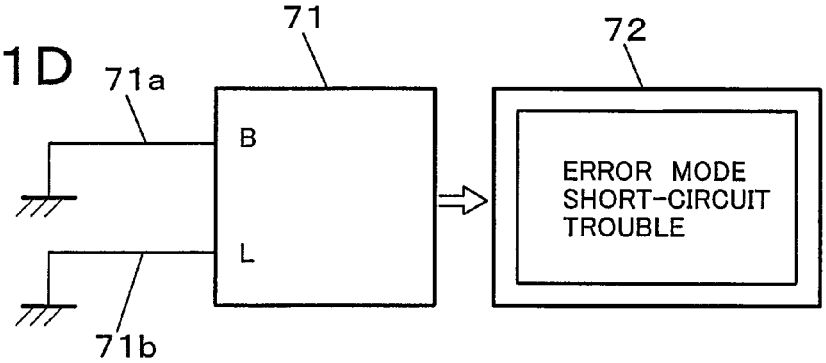

Further, the controller 70 outputs, to the display unit 72, an instruction signal for displaying the results of the reading of the backhoe mode selection signal and loader mode selection signal L. In the case of the determination results that neither the backhoe mode selection signal B nor the loader mode selection signal L was read, the display unit 72 therefore shows an image of details corresponding to the determination results, specifically, as shown in FIG. 11C, an image to the effect that the mode is set in the error mode and to the effect that disconnection trouble has occurred. In the case of the determination results that the backhoe mode selection signal B and the loader mode selection signal L were both read, on the other hand, the display unit 72 shows an image of details corresponding to the determination results, specifically, as shown in FIG. 11D, an image to the effect that the mode is set in the error mode and to the effect that disconnection trouble has occurred.

As shown in FIGS. 10-2, the controller 70 next performs input processing of control signal(s) (step S8). The controller 70 then determines the currently-set mode from the mode setting value when any one of the operation strokes Vbm1, Vbm2, Vbk1, Vbk2, Vam1, Vam2, Vs1, Vs2, Vtr1, Vtr2, Vtl1, Vtl2, Vdo, Vdc is greater than 0, in other words, upon detection of operation of at least one of the boom control lever device 80, bucket control lever device 81, arm control lever device 82, swing control lever device 83, right travel control pedal device 84, left travel control pedal device 85, open control pedal device 86 and close control pedal device 87 (step S9). The mode is determined to be the error mode at the present time.

In the error mode, the controller 70 next calculates the current values of the respective solenoid valve currents Abm1, Abm2, Abk1, Abk2, Aam1, Aam2, As1, As2, Atr1, Atr2, Atl1, Atl2, Ado, Adc, Af1, Af2, Af3 (step S11). Described specifically, the current values of the respective solenoid valve currents Abm1, Abm2, Abk1, Abk2, Aam1, Aam2, As1, As2, Atr1, Atr2, Atl1, Atl2, Ado, Adc, Af1, Af2, Af3 are set at 0 irrespective of the magnitudes of the respective operation strokes Vbm1, Vbm2, Vbk1, Vbk2, Vam1, Vam2, Vs1, Vs2, Vtr1, Vtr2, Vtl1, Vtl2, Vdo2, Vdc2 (step S12). It is to be noted that, when the first embodiment is mounted on the backhoe excavator 200, the calculation of the solenoid valve currents Ado, Adc is not performed because neither the open control pedal device 86 nor the close control pedal device 87 is connected to the controller 70.

The controller 70 next performs output processing of the solenoid valve currents Abm1, Abm2, Abk1, Abk2, Aam1, Aam2, As1, As2, Atr1, Atr2, Atl1, Atl2, Ado, Adc, Af1, Af2, Af3 (step S13).

As the current values of all the solenoid valve currents Abm1, Abm2, Abk1, Abk2, Aam1, Aam2, As1, As2, Atr1, Atr2, Atl1, Atl2, Ado, Adc, Af1, Af2, Af3 are 0 at the present time, none of the solenoid valve currents Abm1, Abm2, Abk, Abk2, Aam1, Aam2, As1, As2, Atr1, Atr2, Atl1, Atl2, Ado, Adc, Af1, Af2, Af3 are outputted actually. In other words, none of the $1^{st}$, $2^{nd}$ and $3^{rd}$ flow-rate control solenoid valves 41, 42, 43 and $1^{st}$-$16^{th}$ directional control solenoid values 51-66 operate. As a consequence, none of the regulators 11*a*-18*a* for the $1^{st}$-$8^{th}$ variable-displacement hydraulic pumps 11-18 operate.

Subsequent to the output processing, the controller 70 causes the routine to return to step S8.

As the $1^{st}$-$15^{th}$ directional control valves 21-35 and $1^{st}$-$8^{th}$ variable-displacement hydraulic pumps 11-18 are controlled as described above, the $1^{st}$-$15^{th}$ directional control valves 21-34 and $1^{st}$-$8^{th}$ variable-displacement hydraulic pumps 11-18 are also maintained in inoperative states, irrespective of operation of any one or more of the boom control lever device 80, bucket control lever device 81, arm control lever device 82, swing control lever device 83, right travel control pedal device 84, left travel control pedal device 85, open control pedal device 86 and close control pedal device 87, when the backhoe mode selection signal B and the loader mode selection signal L are both OFF or when the backhoe mode selection signal B and the loader mode selection signal L are both ON.

According to the first embodiment, the following advantages effects can be obtained.

The first embodiment can selectively constitute a first hydraulic drive circuit for backhoe excavator or a second hydraulic drive circuit for loader excavator without changing the numbers and arrangements of variable-displacement hydraulic pumps and directional control valves or reassembling hydraulic hoses and hydraulic lines in the hydraulic circuit 1. By keeping the first connector connected and keeping the second connector disconnected in the mode instruction means 71, specifically by instructing the selection of the backhoe mode to the controller 70 through the mode instruction means 71, the control of the $1^{st}$, $2^{nd}$ and $3^{rd}$ flow-rate control solenoid valves 41, 42, 43 and $1^{st}$-$16^{th}$ directional control solenoid valves 51-66 can be performed by the controller 70 such that the hydraulic circuit 1 functions as the first hydraulic drive circuit for backhoe excavator. By keeping the first connector disconnected and keeping the second connector connected in the mode instruction means 71, specifically by instructing the selection of the loader mode to the controller 70 through the mode instruction means 71, on the other hand, the control of the $1^{st}$, $2^{nd}$ and $3^{rd}$ flow-rate control solenoid valves 41, 42, 43 and $1^{st}$-$16^{th}$ directional control solenoid valves 51-66 can be performed by the controller 70 such that the hydraulic circuit 1 functions as the second hydraulic drive circuit for loader excavator. Owing to the foregoing, the first embodiment makes it possible to easily change the machine mode from one corresponding to the backhoe excavator 200 to one corresponding to the loader excavator 300 or vice versa, and therefore, to reduce the labor required for the above-described change work and also to shorten the time required for the work.

In the first embodiment, the mode can be set in the backhoe mode by bringing the second connector into the disconnected state while maintaining the first connector in the connected state, and the mode can also be set in the loader mode by bringing the second connector into the connected state while maintaining the first connector in the disconnected state. Specifically, the mode change can be conducted by simple work, that is, by pulling out or pushing in the connectors, and therefore, the mode can be changed with ease. Further, the $1^{st}$ and $2^{nd}$ signal generation circuits 71*a*, 71*b* each of which includes both of the $1^{st}$ and $2^{nd}$ connectors are electric circuits of simple construction, so that any trouble can be readily found and maintenance can be performed with ease.

In the first embodiment, the computer of the controller 70 is configured to perform mode setting by performing reading of the backhoe mode selection signal B and loader mode selection signal L only once between power on and power off before the control of the $1^{st}$, $2^{nd}$ and $3^{rd}$ flow-rate control solenoid valves 41, 42, 43 and the $1^{st}$-$16^{th}$ directional control solenoid valves 51-66 are first initiated. As a consequence, it is possible to prevent a switch from the backhoe mode to the loader mode or any switch from the loader mode to the backhoe mode even when a disconnection or short-circuit occurs in the $1^{st}$ signal generation circuit 71*a* or $2^{nd}$ signal generation circuit 71*b* during work by the hydraulic excavator. Namely, it is possible to prevent a faulty operation of the hydraulic excavator which would otherwise be caused by a disconnection or short-circuit in the $1^{st}$ and $2^{nd}$ signal generation circuits 71*a*, 71*b*.

In the first embodiment, it is possible to confirm, by taking a look at an image shown on the display unit 72, whether or not the results of reading of the backhoe selection signal and loader mode selection signal by the computer of the controller 70 are consistent with the corresponding results of the states of the first and second connectors. The first embodiment can, therefore, contribute to the detection of mix-up of the states of the first and second connectors corresponding to each of the backhoe mode and loader mode and also to the detection of a disconnection or short-circuit in the first or second signal generation circuit.

Second Embodiment

A description will be made about a second embodiment.

Figure 12:
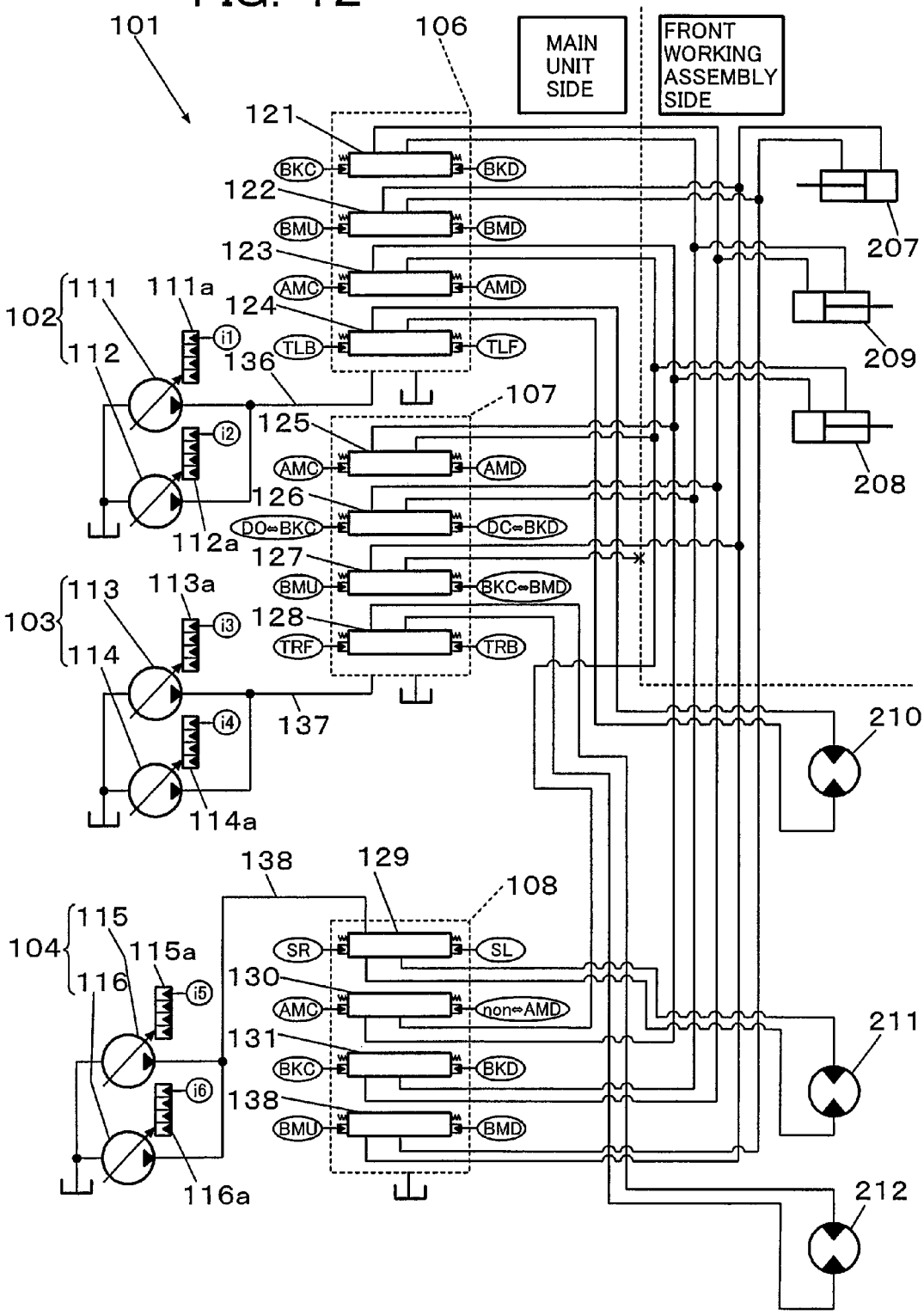
FIG. 12 is a diagram illustrating a state that a hydraulic circuit arranged in a second embodiment is connected to the boom cylinder, arm cylinder and bucket cylinder in a front working assembly for the backhoe excavator.
Figure 13:
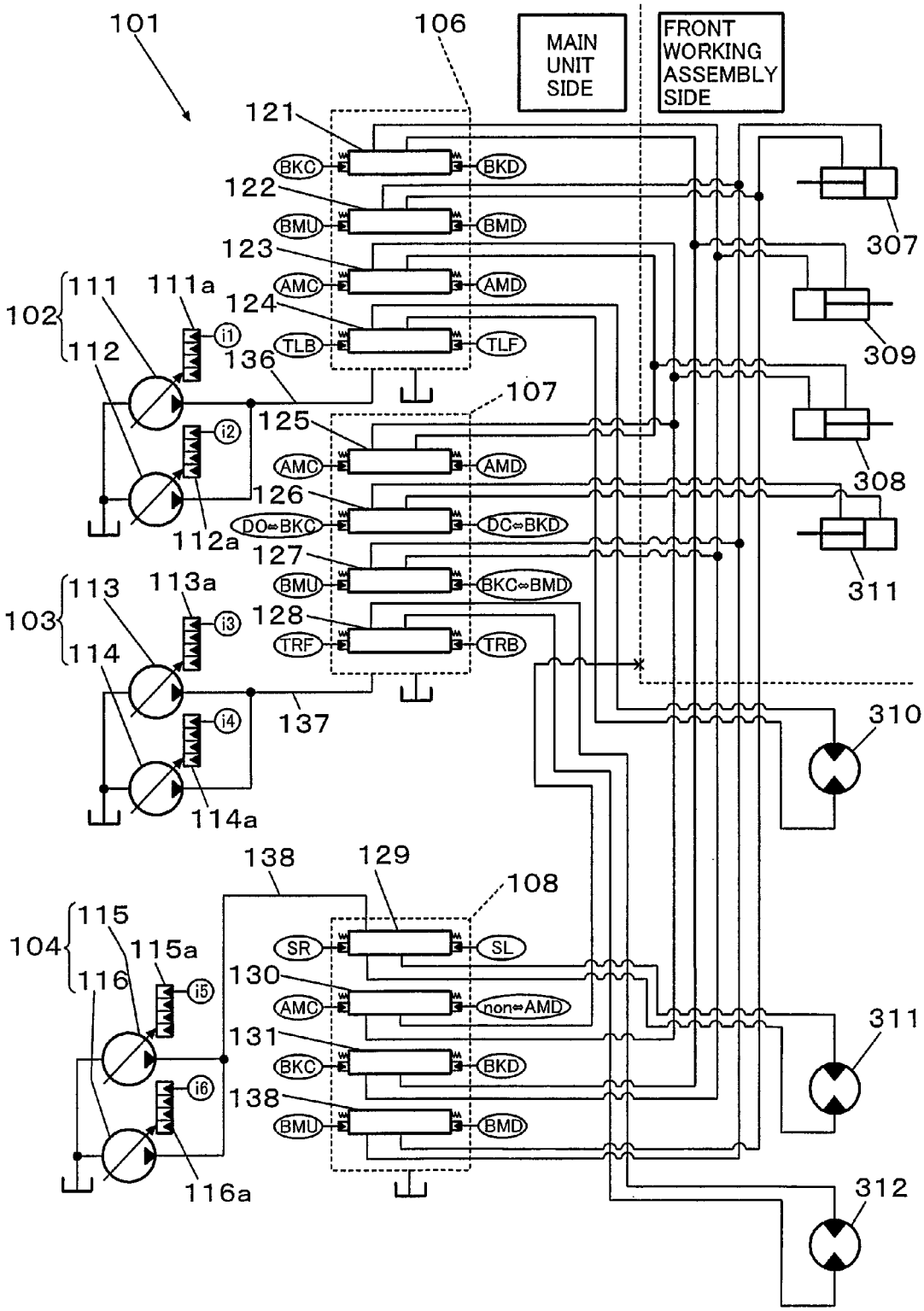
FIG. 13 is a diagram showing a state that the hydraulic circuit depicted in FIG. 12 is connected to the boom cylinder, arm cylinder, bucket cylinder and open/close cylinder in a front working assembly for the loader excavator.

FIG. 12 is a diagram illustrating a state that a hydraulic circuit arranged in the second embodiment is connected to the boom cylinder, arm cylinder and bucket cylinder in the front working assembly for the backhoe excavator. FIG. 13 is a diagram showing a state that the hydraulic circuit depicted in FIG. 12 is connected to the boom cylinder, arm cylinder, bucket cylinder and open/close cylinder in the front working assembly for the loader excavator.

The second embodiment is provided with a hydraulic circuit 101 depicted in FIGS. 12 and 13. This hydraulic $6^{th}$ circuit 101 is provided with $1^{st}$-$6^{th}$ variable-displacement hydraulic pumps 111-116 and $1^{st}$-$12^{th}$ directional control valves 121-132.

The $1^{st}$-$6^{th}$ variable-displacement hydraulic pumps 111-116 are grouped into a $1^{st}$ pump unit 102 comprised of the $1^{st}$ variable-displacement hydraulic pump 111 and $2^{nd}$ variable-displacement hydraulic pump 112, a $2^{nd}$ pump unit 103 comprised of the $3^{rd}$ variable-displacement hydraulic pump 113 and $4^{th}$ variable-displacement hydraulic pump 114, and a $3^{rd}$ pump unit 104 comprised of the $5^{th}$ variable-displacement hydraulic pump 115 and $6^{th}$ variable-displacement hydraulic pump 116.

The $1^{st}$-$12^{th}$ directional control valves 121-132 are grouped into a $1^{st}$ valve group 106 comprised of the $1^{st}$-$4^{th}$ directional control valves 121-124, a $2^{nd}$ valve group 107 comprised of the $5^{th}$-$8^{th}$ directional control valves 125-128, and a $3^{rd}$ valve group 108 comprised of the $9^{th}$-$12^{th}$ directional control valves 129-132.

To these $1^{st}$, $2^{nd}$ and $3^{rd}$ valve groups 106, 107, 108, the $1^{st}$, $2^{nd}$ and $3^{rd}$ pump units 102, 103, 104 are connected, respectively, via lines each of which combines together oils delivered from the two variable-displacement hydraulic pumps that make up the corresponding pump unit, that is, lines 136, 137, 138.

The $1^{st}$ and $11^{th}$ directional control valves 121, 131 are arranged such that they can perform selective switching of flow rate and flow direction of pressure oil corresponding to each of an extension and a retraction of the bucket cylinder 209 arranged on the backhoe excavator 200 and selective switching of flow rate and flow direction of pressure oil corresponding to each of an extension and a retraction of the bucket cylinder 309 arranged on the loader excavator 300.

The $2^{nd}$ and $12^{th}$ directional control valves 122, 132 are arranged such that they can perform selective switching of flow rate and flow direction of pressure oil corresponding to each of an extension and a retraction of the boom cylinder 207 arranged on the backhoe excavator 200 and selective switching of flow rate and flow direction of pressure oil corresponding to each of an extension and a retraction of the boom cylinder 307 arranged on the loader excavator 300.

The $3^{rd}$ and $5^{th}$ directional control valves 123, 125 are arranged such that they can perform selective switching of flow rate and flow direction of pressure oil corresponding to each of an extension and a retraction of the arm cylinder 208 arranged on the backhoe excavator 200 and selective switching of flow rate and flow direction of pressure oil corresponding to each of an extension and a retraction of the arm cylinder 308 arranged on the loader excavator 300.

The $4^{th}$ directional control valve 124 is arranged such that it can perform selective switching of flow rate and flow direction of pressure oil corresponding to each of rotations in opposite two directions of the left travel motor 210 arranged on the backhoe excavator 200 and selective switching of flow rate and flow direction of pressure oil corresponding to each of rotations in opposite two directions of the left travel motor 310 arranged on the loader excavator 300.

The $6^{th}$ directional control valve 126 is arranged such that it can perform selective switching of flow rate and flow direction of pressure oil corresponding to each of an extension and a retraction of the bucket cylinder 209 arranged on the backhoe excavator 200 and selective switching of flow rate and flow direction of pressure oil corresponding to each of an extension and a retraction of the open/close cylinder 313 arranged on the loader excavator 300.

The $7^{th}$ directional control valve 127 is arranged such that it can perform selective switching of flow rate and flow direction of pressure oil corresponding to an extension of the boom cylinder 207 arranged on the backhoe excavator 200 and selective switching of flow rate and flow direction of pressure oil corresponding to each of an extension of the boom cylinder 307 arranged on the loader excavator 300 and an extension of the bucket cylinder 309 arranged on the loader excavator 300.

The $8^{th}$ directional control valve 128 is arranged such that it can perform selective switching of flow rate and flow direction of pressure oil corresponding to each of rotations in opposite two directions of the right travel motor 212 arranged on the backhoe excavator 200 and selective switching of flow rate and flow direction of pressure oil corresponding to each of rotations in opposite two directions of the right travel motor 312 arranged on the loader excavator 300.

The $9^{th}$ directional control valve 129 is arranged such that it can perform selective switching of flow rate and flow direction of pressure oil corresponding to each of rotations in opposite two directions of the swing motor 211 arranged on the backhoe excavator 200 and selective switching of flow rate and flow direction of pressure oil corresponding to each of rotations in opposite two directions of the swing motor 311 arranged on the loader excavator 300.

The $10^{th}$ directional control valve 130 is arranged such that it can perform selective switching of flow rate and flow direction of pressure oil corresponding to each of an extension and a retraction of the arm cylinder 208 arranged on the backhoe excavator 200 and selective switching of flow rate and flow direction of pressure oil corresponding to only an extension out of the extension and a retraction of the arm cylinder 308 arranged on the loader excavator 300.

Figure 14:
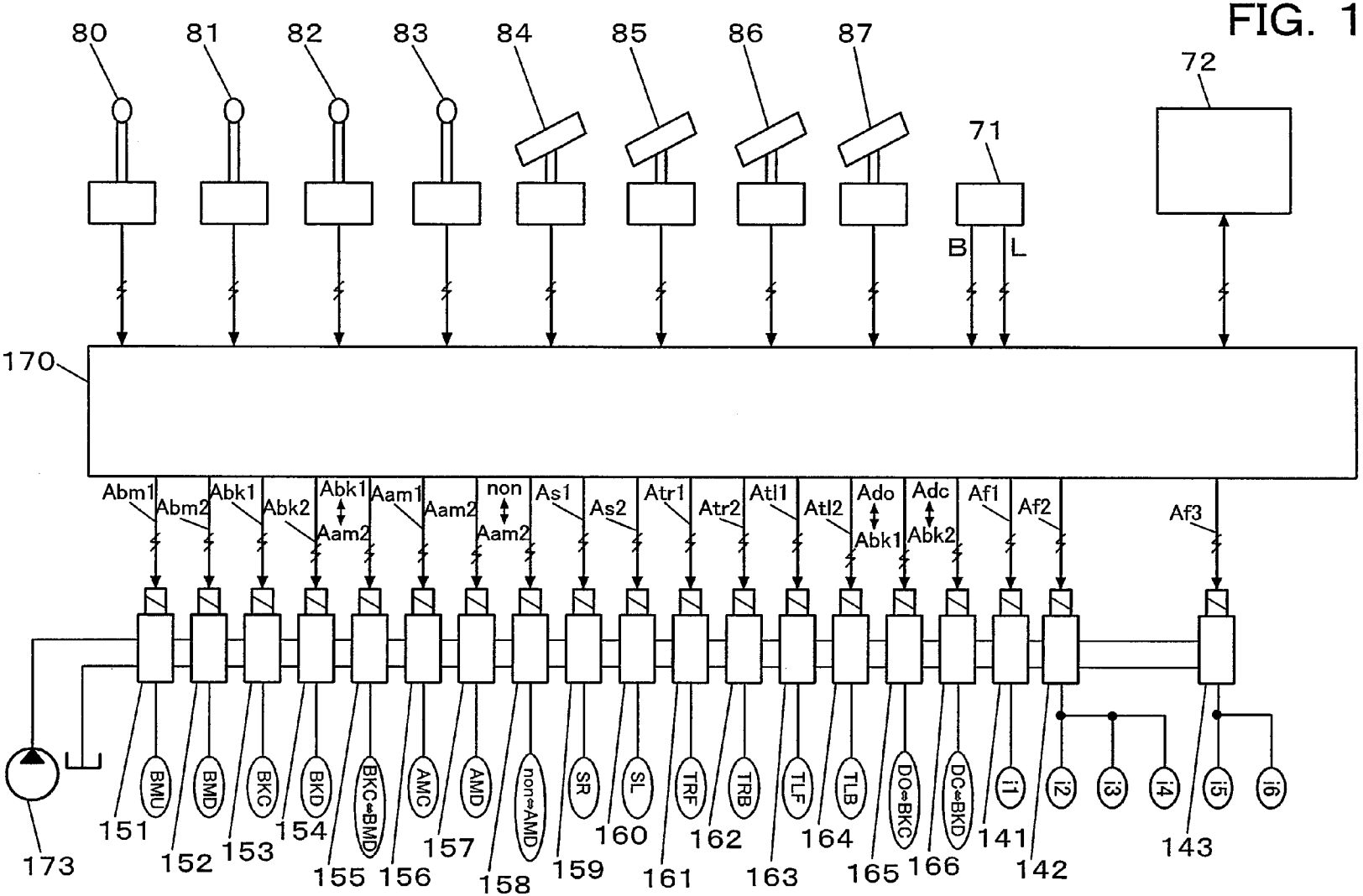
FIG. 14 is a block diagram illustrating a system which the second embodiment is provided with to control the hydraulic circuits shown in FIGS. 12 and 13.

FIG. 14 is a block diagram illustrating a system according to a second embodiment in order to control the hydraulic circuits shown in FIGS. 12 and 13. In this FIG. 14, components equivalent to the corresponding ones depicted in FIG. 5 are identified by the same signs as the signs used in FIG. 5.

As depicted in FIG. 14, the second embodiment is provided with plural flow-rate control solenoid valves, specifically $1^{st}$, $2^{nd}$ and $3^{rd}$ flow-rate control solenoid valves 141, 142, 143 arranged such that the pilot pressures i1-i6 can be applied to the regulators 11*a*-116*a* for the $1^{st}$-$6^{th}$ variable-displacement hydraulic pumps 111-116. The second embodiment is also provided with plural directional control solenoid valves, specifically $1^{st}$-$16^{th}$ directional control solenoid valves 151-166 arranged such that the pilot pressures BMU, BMD, BKC, BKD, AMC, AMD, SR, SL, TRF, TRB, TLF, TLB, DO, DC can be applied to the $1^{st}$-$12^{th}$ directional control valves 121-132. The second embodiment is further provided with a pilot pump 173 as a hydraulic pressure source for the pilot pressures i1-i6 and the pilot pressures BMU, BMD, BKC, BKD, AMC, AMD, SR, SL, TRF, TRB, TLF, TLB, DO, DC. The $1^{st}$, $2^{nd}$ and $3^{rd}$ flow-rate control solenoid valves 141, 142, 143 and the $1^{st}$-$16^{th}$ directional control solenoid valves 151-166 are comprised of proportional solenoid control valves.

The $1^{st}$ flow-rate control solenoid valve 141 is arranged such that a pilot pressure can be applied to only the regulator 111*a* for the $1^{st}$ variable-displacement hydraulic pump 111 out of the regulators 111*a*-116*a* for the $1^{st}$-$6^{th}$ variable-displacement hydraulic pumps 111-116. The $2^{nd}$ flow-rate control solenoid valve 142 is arranged such that pilot pressures can be applied to only the regulators 112*a*, 113*a*, 114*a* for the $2^{nd}$, $3^{rd}$ and $4^{th}$ variable-displacement hydraulic pump 112, 113, 114 out of the regulators 111*a*-116*a* for the $1^{st}$-$6^{th}$ variable-displacement hydraulic pumps 111-116. The $3^{rd}$ flow-rate control solenoid valve 143 is arranged such that pilot pressures can be applied to only the regulators 115*a*, 116*a* for the $5^{th}$ and $6^{th}$ variable-displacement hydraulic pumps 115, 116 out of the regulators 111*a*-116*a* for the $1^{st}$-$6^{th}$ variable-displacement hydraulic pumps 111-116.

The $1^{st}$ directional control solenoid valve 151 is arranged such that the pilot pressure BMU can be applied to the $2^{nd}$, $7^{th}$ and $12^{th}$ directional control valves 121, 127, 132. The $2^{nd}$ directional control solenoid valve 152 is arranged such that the pilot pressure BMD can be applied to the $2^{nd}$ and $12^{th}$ directional control valves 122, 132.

The $3^{rd}$ directional control solenoid valve 153 is arranged such that the pilot pressure BKC can be applied to the 1st and $11^{th}$ directional control valves 121, 131. The $4^{th}$ directional control solenoid valve 154 is arranged such that the pilot pressure BKD can be applied to the $1^{st}$ and $11^{th}$ directional control valves 121, 131.

The $5^{th}$ directional control solenoid valve 155 is arranged such that the pilot pressure BMD or BKC can be applied to the $7^{th}$ directional control valve 127.

The $6^{th}$ directional control solenoid valve 156 is arranged such that the pilot pressure AMC can be applied to the $3^{rd}$, $5^{th}$ and $10^{th}$ directional control solenoid valves 123, 125, 130. The $7^{th}$ directional control solenoid valve 157 is arranged such that the pilot pressure AMD can be applied to the $3^{rd}$ and $5^{th}$ directional control solenoid valves 123, 125.

The $8^{th}$ directional control solenoid valve 158 is arranged such that the pilot pressure AMD can be applied to the $10^{th}$ directional control solenoid valve 130.

The $9^{th}$ directional control solenoid valve 159 is arranged such that the pilot pressure SR can be applied to the $9^{th}$ directional control valve 129. The $10^{th}$ directional control solenoid valve 160 is arranged such that the pilot pressure SL can be applied to the $9^{th}$ directional control valve 129.

The $11^{th}$ directional control solenoid valve 161 is arranged such that the pilot pressure TRF can be applied to the $8^{th}$ directional control valve 128. The $12^{th}$ directional control solenoid valve 162 is arranged such that the pilot pressure TRB can be applied to the $8^{th}$ directional control valve 128.

The $13^{th}$ directional control solenoid valve 163 is arranged such that the pilot pressure TLF can be applied to the $4^{th}$ directional control valve 124. The $14^{th}$ directional control solenoid valve 164 is arranged such that the pilot pressure TLB can be applied to the $4^{th}$ directional control valve 124.

The $15^{th}$ directional control solenoid valve 165 is arranged such that the pilot pressure BK or DO can be applied to the $6^{th}$ directional control valve 126. The $16^{th}$ directional control solenoid valve 166 is arranged such that the pilot pressure BKD or DC can be applied to the $6^{th}$ directional control valve 126.

Similar to the controller 70 in the first embodiment, the controller 170 in the second embodiment is set to convert the operation strokes Vbm1, Vbm2, Vbk1, Vbk2, Vam1, Vam2, Vs1, Vs2, Vtr1, Vtr2, Vtl1, Vtl2, Vdo2, Vdc2 into the solenoid valve currents Abm1, Abm2, Abk1, Abk2, Aam1, Aam2, As1, As2, Atr1, Atr2, Atl1, Atl2, Ado, Adc.

For the backhoe mode and for the loader mode, the controller 170 is set the same with respect to the kinds of solenoid valve currents to be applied to the $1^{st}$-$4^{th}$, $6^{th}$, $7^{th}$, and $9^{th}$-$14^{th}$ directional control solenoid valves 151-154, 156, 157, 159-164, respectively. Described specifically, the controller is set to apply the solenoid valve currents Abm1, Abm2, Abk1, Abk2, Aam1, Aam2, As1, As2, Atr1, Atr2, Atl1, Atl2, Ado, Adc to the $1^{st}$-$4^{th}$, $6^{th}$, $7^{th}$, and $9^{th}$-$14^{th}$ directional control solenoid valves 151-154, 156, 157, 159-164, respectively.

With respect to the kinds of solenoid valve currents to be applied to the $5^{th}$, $8^{th}$, $15^{th}$ and $16^{th}$ directional control solenoid valves 155, 158, 165, 166, respectively, on the other hand, the controller is set differently between the backhoe mode and the loader mode. Described specifically, the controller is set such that in the backhoe mode, the solenoid valve current Abm2 is applied to the $5^{th}$ directional control solenoid valve 155, the solenoid valve current Aam2 is applied to the $8^{th}$ direct ional control solenoid valve 158, the solenoid valve current Abk1 is applied to the $15^{th}$ directional control solenoid valve 165, and the solenoid valve current Abk2 is applied to the $16^{th}$ directional control solenoid valve 166. In the loader mode, on the other hand, the controller is set such that the solenoid valve current Abk1 is applied to the $5^{th}$ directional control solenoid valve 155, no solenoid valve current is applied to the $8^{th}$ directional control solenoid valve 158, the solenoid valve current Ado is applied to the $15^{th}$ directional control solenoid valve 165, and the solenoid valve current Adc is applied to the $16^{th}$ directional control solenoid valve 166.

Concerning the setting of the controller 170 for the solenoid valve current Af1, Af2, Af3 for controlling the $1^{st}$, $2^{nd}$ and $3^{rd}$ flow-rate control solenoid valves 141, 142, 143 in the second embodiment, a detailed description will be omitted. In the backhoe mode, however, the controller is set to inhibit an excess in the operation speeds of the bucket 206 and arm 205 during bucket-dumping operation or arm-crowding operation. In the loader mode, on the other hand, the controller is set to inhibit an excess in the operation speed of the arm 305 during arm-crowding operation. This setting is suited for backhoe excavators and loader excavators of specifications that the digging force and workload are smaller than those required for the backhoe excavator 200 and loader excavator 300 to which the first embodiment is applied.

According to the second embodiment, the following advantageous effects can be obtained.

For similar reasons as in the first embodiment, the second embodiment makes it possible to easily change the machine mode from one corresponding to a backhoe excavator to one corresponding to a loader excavator or vice versa. Therefore, it is possible to reduce the labor required for the above-described change work and also to shorten the time required for the work.

In particular, the second embodiment can be applied to models required to meet digging force and workloads smaller than those required for the backhoe excavator 200 and loader excavator 300, that is, models which are large hydraulic excavators but are smaller than the backhoe excavator 200 and loader excavator 300, because the second embodiment is provided with the hydraulic circuit 101 including fewer variable displacement hydraulic pumps and directional control valves than the hydraulic circuit 1 arranged in the first embodiment.

The first and second embodiments are each provided with the plural flow-rate control solenoid valves as pump flow-rate control means, the directional control solenoid valves as directional control means and the controller as regulation means such that control of the regulators for the variable-displacement hydraulic pumps and the directional control valves in the hydraulic circuit 1 or 101 can be realizing using electronic control. It is, however, to be noted that the present invention is not limited to such hydraulic circuits and that a hydraulic circuit may be constructed to permit, with only hydraulic pilot pressures, the realization of control of the regulators and directional control valves in accordance with the control lever devices and control pedal devices.

The first embodiment is, as mentioned above, provided with the hydraulic circuit 1 including the eight variable-displacement hydraulic pumps and fifteen directional control valves. The second embodiment is, as mentioned above, provided with the hydraulic circuit 101 including the twelve variable-displacement hydraulic pumps and twelve directional control valves. These hydraulic circuits 1, 101 are examples of a hydraulic circuit including at least two variable-displacement hydraulic pumps and at least seven directional control valves, that is, examples of a hydraulic circuit for a large hydraulic excavator, to which the present invention can be applied. In other words, the hydraulic circuit to which the present invention can be applied is not limited to the hydraulic circuit 1 or 101, but can be any hydraulic circuit including at least two variable-displacement hydraulic pumps and at least seven directional control valves arranged on the revolving upperstructure of a large hydraulic excavator such that a hydraulic drive circuit for backhoe excavator or a hydraulic drive circuit for loader excavator can be selectively constructed.

LEGEND

1 Hydraulic circuit
2-5 $1^{st}$-$4^{th}$ Pump combinations
6-9 $1^{st}$-$4^{th}$ Valve groups
11-18 $1^{st}$-$8^{th}$ Variable-displacement hydraulic pumps
11*a*-18*a* Regulators
21-35 $1^{st}$-$15^{th}$ directional control valves
36-39 Lines
41, 42, 43 $1^{st}$-$3^{rd}$ flow-rate control solenoid valves
51-66 $1^{st}$-$16^{th}$ directional control solenoid valves
70 Controller
71 Mode instruction means
71*a* $1^{st}$ signal generation circuit
71*b* $2^{nd}$ signal generation circuit
72 Display unit
73 Pilot pump
80 Boom control lever device
80*a* Control lever
80*b* Angle detector
81 Bucket control lever device
82 Arm control lever device
83 Swing control lever device
84 Right travel control pedal device
84*a* Control pedal
84*b* Angle detector
85 Left travel control pedal device
86 Open control pedal device
87 Close control pedal device
101 Hydraulic circuit
102-104 $1^{st}$, $2^{nd}$, $3^{rd}$ pump combinations
106-108 $1^{st}$, $2^{nd}$, $3^{rd}$ valve groups
111-116 $1^{st}$-$6^{th}$ Variable-displacement hydraulic pumps
111*a*-116*a* Regulators
121-132 $1^{st}$-$12^{th}$ Directional control valves
136-138 Lines
141, 142, 143 $1^{st}$-$3^{rd}$ Flow-rate control solenoid valves
151-166 $1^{st}$-$16^{th}$ Directional control solenoid valves
170 Controller
173 Pilot pump
200 Backhoe excavator
201 Travel base
202 Revolving upperstructure
202*a* Operator's cab
203 Front working assembly
204 Boom
205 Arm
206 Bucket
207 Boom cylinder
208 Arm cylinder
209 Bucket cylinder
210 Left travel motor
211 Swing motor
212 Right travel motor
300 Loader excavator
301 Travel base
302 Swing upperstructure
302*a* Operator's cab
303 Front working assembly
304 Boom
305 Arm
306 Bucket

307 Boom cylinder
308 Arm cylinder
309 Bucket cylinder
310 Left travel motor
311 Swing motor
312 Right travel motor
313 Open/close cylinder

The invention claimed is:

1. A hydraulic drive system for a large hydraulic excavator, comprising:

a hydraulic circuit comprising at least two variable-displacement hydraulic pumps and at least seven directional control valves, said hydraulic circuit being operatively arranged on a revolving upperstructure of said large hydraulic excavator such that a first hydraulic drive circuit for a backhoe excavator, which comprises said at least two variable-displacement hydraulic pumps and at least six of said directional control valves to form a flow of pressure oil required for driving a right travel motor, a left travel motor, a swing motor, a boom cylinder, an arm cylinder and a bucket cylinder provided on said large backhoe excavator, and a second hydraulic drive circuit for a loader excavator, which comprises said at least two variable-displacement hydraulic pumps and said at least seven directional control valves to form a flow of pressure oil required for driving a right travel motor, a left travel motor, a swing motor, a boom cylinder, an arm cylinder, a bucket cylinder and an open/close cylinder provided on said large loader excavator, are selectively configurable, a pump flow-rate control means for controlling flow rates of said at least two variable-displacement hydraulic pumps, respectively, a directional control means for controlling valve positions of said at least seven directional control valves, respectively, a regulation means for performing control of said pump flow-rate control means and said directional control means in one mode selected from at least two predetermined modes, and a mode instruction means for instructing said one mode to be selected by said regulation means from said at least two predetermined modes, wherein:

said at least two predetermined modes comprises a backhoe mode, in which said pump flow-rate control means and said directional control means are controlled to make said hydraulic circuit function as said first hydraulic drive circuit for said backhoe excavator, and a loader mode, in which said pump flow-rate control means and said directional control means are controlled to make said hydraulic circuit function as said second hydraulic drive circuit for said loader excavator, said pump flow-rate control means comprises hydraulic pilot-operated regulators and plural flow-rate control solenoid valves arranged such that pilot pressures are appliable to said regulators for said respective variable-displacement hydraulic pumps, said directional control valves comprise hydraulic pilot-operated directional control valves, said directional control means comprises plural directional control solenoid valves arranged such that pilot pressures are appliable to said respective directional control valves, said regulation means comprises a computer operatively configured to control said pump flow-rate control means and said directional control valve control means in either of said at least two predetermined modes by electronic control of said plural flow-rate control solenoid valves and said plural directional-control solenoid valves, said mode instruction means comprises an electric circuit for generating an electric signal that instructs which mode is to be selected from said at least two predetermined modes by the computer, said electric circuit comprises a first signal generation circuit for generating a backhoe mode selection signal that instructs selection of said backhoe mode, a first connector capable of switching on/off said first signal generation circuit, a second signal generation circuit for generating a loader mode selection signal that instructs selection of said loader mode, and a second connector capable of switching on/off said second signal generation circuit, said computer is configured to perform mode setting by performing reading of said backhoe mode selection signal and loader mode selection signal only once between power on and power off before control of said plural flow-rate control solenoid valves and control of said directional control solenoid valves are first initiated, said hydraulic drive system is provided with a display for displaying results of said reading of said backhoe mode selection signal and said loader mode selection signal, said at least two predetermined modes comprise an error mode in which control is performed to prevent operation of said plural flow-rate control solenoid valves and plural directional control solenoid valves, said computer is configured to set the mode in said error mode when said results of said reading are results that said backhoe mode selection signal and said loader mode selection signal have been both read, and said computer is configured to set the mode in said error mode when said results of said reading are results that neither said backhoe mode selection signal nor said loader mode selection signal has been read.

2. A hydraulic drive system according to claim 1, wherein:

said at least two variable-displacement hydraulic pumps comprise first to eighth variable-displacement hydraulic pumps, and said first to eighth variable-displacement hydraulic pumps are grouped into a first pump unit composed of the first variable-displacement hydraulic pump and the second variable-displacement hydraulic pump, a second pump unit composed of the third variable-displacement hydraulic pump and the fourth variable-displacement hydraulic pump, a third pump unit composed of the fifth variable-displacement hydraulic pump and the sixth variable-displacement hydraulic pump, and a fourth pump unit composed of the seventh variable-displacement hydraulic pump and the eighth variable-displacement hydraulic pump, said at least seven directional control valves comprise first to fifteenth directional control valves, and said first to fifteenth directional control valves are grouped into a first valve group composed of the first to fourth directional control valves, a second valve group composed of the fifth to eighth directional control valves, a third valve group composed of the ninth to eleventh directional control valves, and a fourth valve group composed of the twelfth to fifteenth directional control valves, wherein:

said first to fourth pump units are connected to these first to fourth valve groups, respectively, via lines each of which combines together said two variable-displacement hydraulic pumps that make up the corresponding pump unit, said first, fifth and fourteenth directional control valves are arranged such that selective switching of flow rate and flow direction of pressure oil corresponding to each of an extension and a retraction of said boom cylinder provided on said backhoe excavator and selective switching of flow rate and flow direction of pressure oil corresponding to each of an extension and a retraction of said boom cylinder provided on said loader excavator is capable, said second, sixth and thirteenth directional control valves are arranged such that selective switching of flow rate and flow direction of pressure oil corresponding to each of an extension and a retraction of said bucket cylinder provided on said backhoe excavator and selective switching of flow rate and flow direction of pressure oil corresponding to each of an extension and a retraction of said bucket cylinder provided on said loader excavator is capable, said third and seventh directional control valves are arranged such that selective switching of flow rate and flow direction of pressure oil corresponding to each of an extension and a retraction of said arm cylinder provided on said backhoe excavator and selective switching of flow rate and flow direction of pressure oil corresponding to each of an extension and a retraction of said arm cylinder provided on said loader excavator is capable, said fourth directional control valve is arranged such that selective switching of flow rate and flow direction of pressure oil corresponding to each of rotations in opposite two directions of said left travel motor provided on said backhoe excavator and selective switching of flow rate and flow direction of pressure oil corresponding to each of rotations in opposite two directions of said left travel motor provided on said loader excavator is capable, said eighth directional control valve is arranged such that selective switching of flow rate and flow direction of pressure oil corresponding to each of an extension and a retraction of said open/close cylinder provided on said loader excavator is capable, said ninth directional control valve is arranged such that selective switching of flow rate and flow direction of pressure oil corresponding to each of an extension of said bucket cylinder provided on said backhoe excavator and an extension of said arm cylinder provided on said backhoe excavator and selective switching of flow rate and flow direction of pressure oil corresponding to each of an extension of said bucket cylinder provided on said loader excavator and an extension of said arm cylinder provided on said loader excavator is capable, said tenth directional control valve is arranged such that selective switching of flow rate and flow direction of pressure oil corresponding to each of rotations in opposite two directions of said swing motor provided on said backhoe excavator and selective switching of flow rate and flow direction of pressure oil corresponding to each of rotations in opposite two directions of said swing motor provided on said loader excavator is capable, said eleventh directional control valve is arranged such that selection of flow rate and flow direction of pressure oil corresponding to only an extension of the extension and a retraction of said boom cylinder provided on said backhoe excavator and selection of only an extension of the extension and a retraction of said boom cylinder provided on said loader excavator is capable, said twelfth directional control valve is arranged such that selective switching of flow rate and flow direction of pressure oil corresponding to each of rotations in opposite two directions of said right travel motor provided on said backhoe excavator and selective switching of flow rate and flow direction of pressure oil corresponding to each of rotations in opposite two directions of said right travel motor provided on said loader excavator is capable, said fifteenth directional control valve is arranged such that selective switching of flow rate and flow direction of pressure oil corresponding to each of an extension and a retraction of said arm cylinder provided on said backhoe excavator out of said backhoe excavator and loader excavator is capable, said plural flow-rate control solenoid valves comprise first, second and third flow-rate control solenoid valves, said first flow-rate control solenoid valve is arranged such that pilot pressures is appliable to only regulators for the first, third, fifth, sixth, seventh and eighth variable-displacement hydraulic pumps out of regulators for said first to eighth variable-displacement hydraulic pumps, said second flow-rate control solenoid valve is arranged such that a pilot pressure is appliable to only a regulator for the second variable-displacement hydraulic pump out of said regulators for said first to eighth variable-displacement hydraulic pumps, and said third flow-rate control solenoid valve is arranged such that a pilot pressure is appliable to only a regulator for the fourth variable-displacement hydraulic pump out of said regulators for said first to eighth variable-displacement hydraulic pumps.

3. A hydraulic drive system according to claim 1, wherein:

said at least two variable-displacement hydraulic pumps comprise first to sixth variable-displacement hydraulic pumps, and said first to sixth variable-displacement hydraulic pumps are grouped into a first pump unit composed of the first variable-displacement hydraulic pump and the second variable-displacement hydraulic pump, a second pump unit composed of the third variable-displacement hydraulic pump and the fourth variable-displacement hydraulic pump, and a third pump unit composed of the fifth variable-displacement hydraulic pump and the sixth variable-displacement hydraulic pump, said at least seven directional control valves comprise first to twelfth directional control valves, and said first to twelfth directional control valves are grouped into a first valve group composed of the first to fourth directional control valves, a second valve group composed of the fifth to eighth directional control valves, and a third valve group composed of the ninth to twelfth directional control valves, wherein:

said first, second and third pump units are connected to these first to third valve groups, respectively, via lines, each of which combines together said two variable-displacement hydraulic pumps that make up the corresponding pump unit, said first and eleventh directional control valves are arranged such that selective switching of flow rate and flow direction of pressure oil corresponding to each of an extension and a retraction of said bucket cylinder provided on said backhoe excavator and selective switching of flow rate and flow direction of pressure oil corresponding to each of an extension and a retraction of said bucket cylinder provided on said loader excavator is capable, said second and twelfth directional control valves are arranged such that selective switching of flow rate and flow direction of pressure oil corresponding to each of an extension and a retraction of said boom cylinder provided on said backhoe excavator and selective switching of flow rate and flow direction of pressure oil corresponding to each of an extension and a retraction of said boom cylinder provided on said loader excavator is capable, said third and fifth directional control valves are arranged such that selective switching of flow rate and flow direction of pressure oil corresponding to each of an extension and a retraction of said arm cylinder provided on said backhoe excavator and selective switching of flow rate and flow direction of pressure oil corresponding to each of an extension and a retraction of said arm cylinder provided on said loader excavator is capable, said fourth directional control valve is arranged such that selective switching of flow rate and flow direction of pressure oil corresponding to each of rotations in opposite two directions of said left travel motor provided on said backhoe excavator and selective switching of flow rate and flow direction of pressure oil corresponding to each of rotations in opposite two directions of said left travel motor provided on said loader excavator is capable, said sixth directional control valve is arranged such that selective switching of flow rate and flow direction of pressure oil corresponding to each of an extension and a retraction of said bucket cylinder provided on said backhoe excavator and selective switching of flow rate and flow direction of pressure oil corresponding to each of an extension and a retraction of said open/close cylinder provided on said loader excavator is capable, said seventh directional control valve is arranged such that selective switching of flow rate and flow direction of pressure oil corresponding to each of an extension and a retraction of said boom cylinder provided on said backhoe excavator and selective switching of flow rate and flow direction of pressure oil corresponding to each of an extension and a retraction of said bucket cylinder provided on said loader excavator is capable, said eighth directional control valve is arranged such that selective switching of flow rate and flow direction of pressure oil corresponding to each of rotations in opposite two directions of said right travel motor provided on said backhoe excavator and selective switching of flow rate and flow direction of pressure oil corresponding to each of rotations in opposite two directions of said right travel motor provided on said loader excavator is capable, said ninth directional control valve is arranged such that selective switching of flow rate and flow direction of pressure oil corresponding to each of rotations in opposite two directions of said swing motor provided on said backhoe excavator and selective switching of flow rate and flow direction of pressure oil corresponding to each of rotations in opposite two directions of said swing motor provided on said loader excavator is capable, said tenth directional control valve is arranged such that selective switching of flow rate and flow direction of pressure oil corresponding to each of an extension and a retraction of said arm cylinder provided on said backhoe excavator and selection of flow rate and flow direction of pressure oil corresponding to only an extension of the extension and a retraction of said arm cylinder provided on said loader excavator is capable, and said plural flow-rate control solenoid valves comprise first, second and third flow-rate control solenoid valves, said first flow-rate control solenoid valve is arranged such that a pilot pressure is appliable to only a regulator for the first variable-displacement hydraulic pump out of regulators for said first to sixth variable-displacement hydraulic pumps, said second flow-rate control solenoid valve is arranged such that pilot pressures is appliable to only regulators for the second, third and fourth variable-displacement hydraulic pumps out of said regulators for said first to sixth variable-displacement hydraulic pumps, and said third flow-rate control solenoid valve is arranged such that pilot pressures is appliable to only regulators for the fifth and sixth variable-displacement hydraulic pumps out of said regulators for said first to sixth variable-displacement hydraulic pumps.

* * * * *